US011803159B2

(12) United States Patent
Kobayashi

(10) Patent No.: US 11,803,159 B2
(45) Date of Patent: Oct. 31, 2023

(54) ELECTRONIC TIMEPIECE AND INDICATOR POSITION DETECTION METHOD

(71) Applicant: Seiko Epson Corporation, Tokyo (JP)

(72) Inventor: Naohiro Kobayashi, Shiojiri (JP)

(73) Assignee: SEIKO EPSON CORPORATION

( * ) Notice: Subject to any disclaimer, the term of this patent is extended or adjusted under 35 U.S.C. 154(b) by 984 days.

(21) Appl. No.: 16/601,646

(22) Filed: Oct. 15, 2019

(65) Prior Publication Data

US 2020/0117144 A1 Apr. 16, 2020

(30) Foreign Application Priority Data

Oct. 16, 2018 (JP) ..... 2018-194858

(51) Int. Cl.
*G04C 3/14* (2006.01)
*G04C 9/08* (2006.01)

(52) U.S. Cl.
CPC ..... *G04C 9/08* (2013.01); *G04C 3/14* (2013.01)

(58) Field of Classification Search
CPC ..... G04C 9/08; G04C 3/14
See application file for complete search history.

(56) References Cited

U.S. PATENT DOCUMENTS 4,420,263 A 12/1983 Besson et al.
5,999,495 A 12/1999 Hashizume et al.
6,025,690 A * 2/2000 Guerin ..... H02P 8/02 318/685
9,904,252 B2 * 2/2018 Kato ..... G04R 20/08
10,302,465 B2 * 5/2019 Gowreesunker ..... G01D 5/3473
2004/0125702 A1 * 7/2004 Kitajima ..... G04C 3/14 368/80
2009/0296533 A1 * 12/2009 Kojima ..... G04G 19/12 368/185
2010/0020336 A1 * 1/2010 Hosobuchi ..... G04C 3/14 356/614
2011/0141858 A1 * 6/2011 Aoki ..... G04C 3/146 356/138
2017/0017206 A1 * 1/2017 Kato ..... G04R 20/08
2017/0248446 A1 * 8/2017 Gowreesunker ..... G05G 9/047

FOREIGN PATENT DOCUMENTS

JP S58-150881 A 9/1983
JP H10-142356 A 5/1998
JP 2001-013275 A 1/2001
JP 2013-019724 A 1/2013

* cited by examiner

*Primary Examiner* — Sean Kayes
(74) *Attorney, Agent, or Firm* — Harness, Dickey & Pierce, P.L.C.

(57) ABSTRACT

An electronic timepiece that shortens the time from starting to completing indicator position detection. The electronic timepiece 1 an indicator 11; an actuator 12 that drives the indicator 11; a light emitter 21; a photodetector 22 that detects light emitted from the light emitter 21 selectively when when the indicator 11 is at a reference position; and a control circuit 35 that executes a first mode to drive the indicator 11 continuously in one direction until the indicator 11 is detected while the light emitter 21 is emitting, and a second mode to alternately drive the indicator 11 and drive the light emitter 21 to emit to detect the indicator 11 at the reference position after the photodetector 22 detects light in the first mode and the indicator 11 has past the reference position.

9 Claims, 10 Drawing Sheets

| DRIVE FREQUENCY (Hz) | TOTAL DETECTION TIME (s) |
|---|---|
| 30 | 288 |
| 85.3 | 101 |
| 250 | 34.56 |
| 500 | 17.28 |

ELECTRONIC TIMEPIECE AND INDICATOR POSITION DETECTION METHOD

BACKGROUND

1. Technical Field

The present invention relates to an electronic timepiece, a control circuit of an electronic timepiece, and an indicator position detection method.

2. Related Art

JP-A-2013-19724 describes an indicator position detection process that operates an indicator position detection means each time an indicator (hand) of a radio-controlled timepiece is driven rapidly and each time an indicator is driven one step at a time.

However, when the indicator position detection means is operated each time the indicator moves one step with the technology described in JP-A-2013-19724, the time from when detection starts to when detection ends may become long.

SUMMARY

An electronic timepiece according to one aspect of the disclosure has an indicator; an actuator configured to drive the indicator; a light emitter used to detect the indicator; a photodetector configured to detect light emitted from the light emitter selectively when the indicator is at a reference position; and a control circuit configured to control the actuator and the light emitter, and execute a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

An electronic timepiece according to another aspect of the present disclosure has an indicator; an actuator configured to drive the indicator; a wheel configured to transfer power from the actuator to the indicator, and having a through-hole passing through the wheel in the axial direction; a light emitter configured to emit light to the wheel; a photodetector configured to detect light emitted from the light emitter and passing through the through-hole selectively when the indicator is at the reference position; and a control circuit configured to control the actuator and the light emitter, and execute a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

In an electronic timepiece according to another aspect of the present disclosure the control circuit drives the indicator in the opposite direction as the one direction when the photodetector detects light in the first mode, goes to the second mode when the indicator has been driven a specific amount in the opposite direction, and in the second mode alternately drives the indicator in the one direction and drives the light emitter to emit.

In an electronic timepiece according to another aspect of the present disclosure the control circuit, in the second mode, alternately drives the indicator in the opposite direction as the one direction, and drives the light emitter to emit.

In an electronic timepiece according to another aspect of the present disclosure the control circuit executes the processes of the first mode and second mode as an initialization operation during a system reset.

In an electronic timepiece according to another aspect of the present disclosure the actuator is a stepper motor.

In an electronic timepiece according to another aspect of the present disclosure the control circuit, in the second mode, alternately drives the stepper motor one step, and drives the light emitter to emit.

In an electronic timepiece according to another aspect of the present disclosure the control circuit, in the first mode, drives the stepper motor by rated current control.

Another aspect of the present disclosure is a control circuit of an electronic timepiece, the control circuit controlling a light emitter and an actuator that drives an indicator; detecting the indicator in a reference position by a photodetector that detects light emitted from the light emitter selectively when the indicator is at the reference position; and executing a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

Another aspect of the present disclosure is an indicator position detection method including steps of: controlling, by a control circuit, a light emitter and an actuator that drives an indicator; detecting the indicator in a reference position by a photodetector that detects light emitted from the light emitter selectively when the indicator is at the reference position; driving the indicator continuously in one direction until the indicator is detected while the light emitter is emitting; and after the photodetector detects light and the indicator has past the reference position, alternately driving the indicator and driving the light emitter to emit to detect the indicator at the reference position.

Other objects and attainments together with a fuller understanding of the invention will become apparent and appreciated by referring to the following description and claims taken in conjunction with the accompanying drawings.

DESCRIPTION OF EMBODIMENTS

Figure 1:
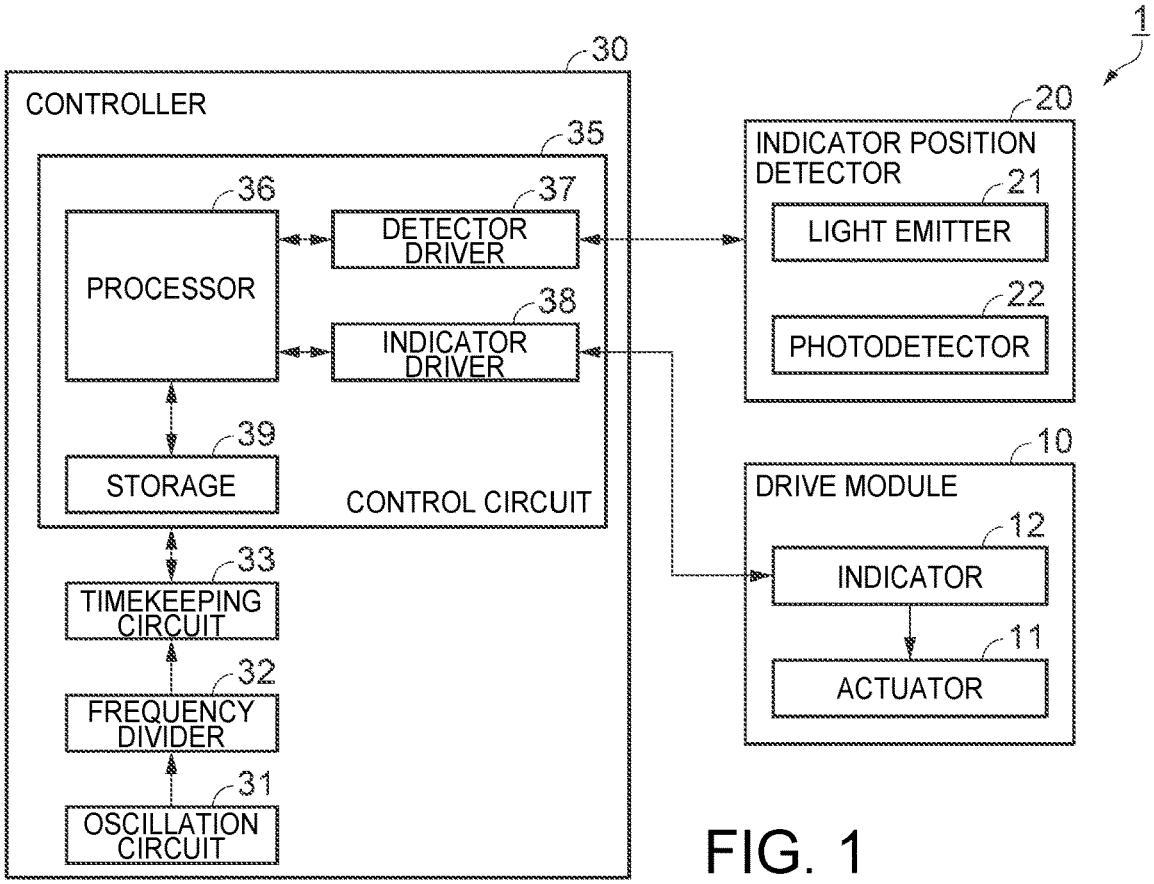
FIG. 1 is a block diagram illustrating the configuration of an electronic timepiece according to a first embodiment.

An electronic timepiece, a control circuit, and a indicator position detection method according to preferred embodiments of the present disclosure are described below with reference to the accompanying figures. The embodiments described below do not limit the content of the invention described in the accompanying claims. All elements of the configurations described below are also not essential to the configuration of the invention. The same or similar reference numerals are also applied to the same or similar elements in the accompanying claims, and duplicative description thereof is omitted. The accompanying figures are also for illustration, and may differ from the actual dimensions, relative dimensions, location, and configuration of the elements.

Embodiment 1

As shown in FIG. 1, an electronic timepiece 1 according to the first embodiment has a drive module 10 with indicators 11 (hands) and an actuator 12 that drives the indicators 11; an indicator position detector 20 including a light emitter 21 and a photodetector 22 that senses light emitted by the light emitter 21; and a controller 30 that controls the drive module 10 and the indicator position detector 20.

The indicators 11 in this embodiment are hands that point to information such as the time on the electronic timepiece 1. The indicators 11 may be a 24-hour hand, the hands of a subdial or chronograph, or other hands for indicating the date, day, alarm setting, sensor values, or other types of information.

The actuator 12 in this example is a single phase stepper motor. The actuator 12 drives the indicators 11 indirectly through a wheel train not shown in FIG. 1, for example.

The light emitter 21 is a light source that emits light in response to a signal input from the controller 30. The light emitter 21 in this example is a light-emitting diode.

The photodetector 22 is a photosensor that outputs a detection signal corresponding to the detected light to the controller 30. The photodetector 22 in this example is a photodiode or a phototransistor. The light emitter 21 and photodetector 22 are disposed so that the photodetector 22 selectively detects light emitted from the light emitter 21 when an indicator 11 is at a predetermined reference position.

The controller 30 includes, for example, an oscillation circuit 31, a frequency divider 32, a timekeeping circuit 33, and a control circuit 35 that controls the actuator 12 and light emitter 21 and detects the reference position of the indicator 11 according to the detected output from the photodetector 22.

The configuration of the hardware resources of the controller 30 can be expressed by a block diagram illustrating a logical structure such as shown in FIG. 1. The controller 30 may be configured from a processing circuit such as a central processing unit (CPU), a storage device such as semiconductor memory, and other integrated circuits (IC) including peripheral circuits and circuit components. The controller 30 may be configured by a single integrated hardware design, or from multiple discrete hardware components. The controller 30 may also be an IC device used to control other operations of the electronic timepiece 1, such as displaying the time.

The oscillation circuit 31 outputs to the frequency divider 32 an oscillation signal acquired from a crystal oscillator by applying voltage to the crystal oscillator.

The frequency divider 32 outputs to the timekeeping circuit 33 a reference signal of a specific frequency acquired by frequency dividing the oscillation signal input from the oscillation circuit 31.

The timekeeping circuit 33 keeps the internal time based on the reference signal input from the frequency divider 32.

The control circuit 35 includes a processor 36, detector driver 37, indicator driver 38, and storage 39.

The processor 36 is a processing circuit such as a CPU. The processor 36 configures a computing system that processes operations required by the indicator position detection method of the electronic timepiece 1. The processor 36 executes functions described in the first embodiment by running a program stored in the storage 39, for example. The processor 36 may be configured by an application specific integrated circuit (ASIC) device arranged to execute specific functions, or a device comprising conventional circuit components.

The storage 39 is a computer-readable storage medium that stores programs and data required for operations of the processor 36, for example. The storage 39 may also include storage devices such as registers incorporated in the CPU or other primary storage devices.

The processor 36 has a first mode in which the indicator 11 is driven continuously in one direction while the light emitter 21 is emitting until the indicator 11 is detected at the reference position, and a second mode in which driving the indicator 11 and driving the light emitter 21 alternate in response to the photodetector 22 detecting light in the first mode. By the processor 36 having a first mode and a second mode, the time from starting to completing detecting the indicator 11 at the reference position can be shortened.

The detector driver 37 drives the indicator position detector 20 according to a drive signal from the processor 36. More specifically, the detector driver 37 drives the light emitter 21 to emit, and receives detection signals input from the photodetector 22.

The indicator driver 38 intermittently drives the indicator 11 by driving the actuator 12 according to a drive signal input from the processor 36.

Figure 2:
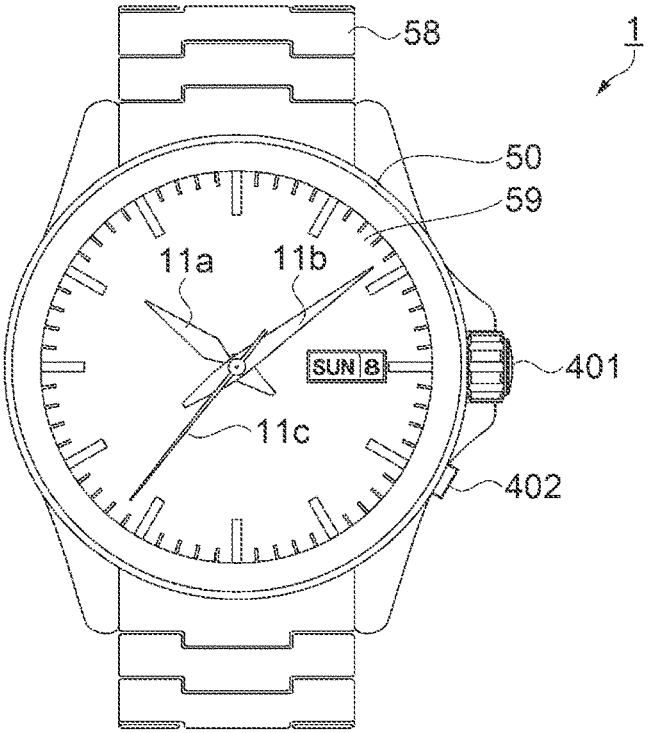
FIG. 2 shows an example of the appearance of an electronic timepiece according to the first embodiment.

As shown in FIG. 2, the electronic timepiece 1 in this embodiment has an hour hand 11*a*, minute hand 11*b*, and second hand 11*c*. In this configuration, the indicator 11 may be any one of the hour hand 11*a*, minute hand 11*b*, and second hand 11*c*. The electronic timepiece 1 in this example is a wristwatch that is worn and held on the wrist of the user by a band 58. The electronic timepiece 1 also has a crown 401 and a button 402 as operating members that are exposed from the case 50 that houses components of the electronic timepiece 1.

Figure 3:
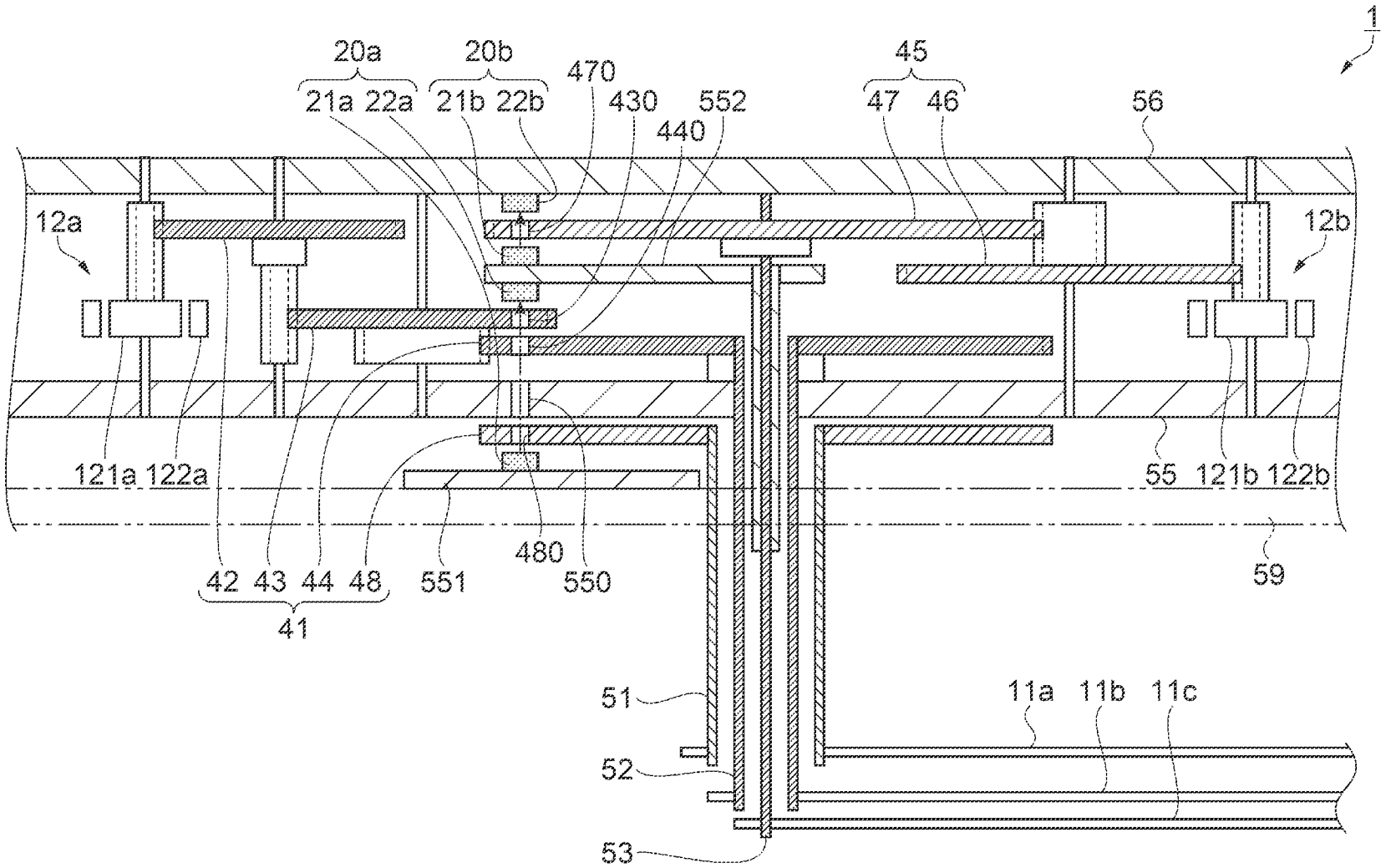
FIG. 3 is a section view shows an example of the drive module of an electronic timepiece according to the first embodiment.

As shown in FIG. 3, the electronic timepiece 1 includes an hour-minute motor 12*a*, which is a stepper motor that drives the hour hand 11*a* and minute hand 11*b*, and a seconds motor 12*b*, which is a stepper motor that drives the second hand 11*c*. Also shown in FIG. 3 are the hour-minute rotor 121*a* and hour-minute stator 122*a* of the hour-minute motor 12*a*, and the seconds rotor 121*b* and seconds stator 122*b* of the seconds motor 12*b*.

In this configuration, the actuator 12 shown in FIG. 1 may be the hour-minute motor 12*a* or the seconds motor 12*b* shown in FIG. 3. More specifically, when the indicator 11 is defined as the hour hand 11*a*, the actuator 12 is defined as the hour-minute motor 12*a* that drives the hour hand 11*a*. If the actuator 12 drives the indicator 11 directly or indirectly as controlled by the controller 30, the actuator 12 is not limited to a stepper motor and may be a piezoelectric actuator or other type of actuator.

As shown in FIG. 3, the electronic timepiece 1 also has a first detector 20*a*, a second detector 20*b*, an hour-minute wheel train 41, a seconds wheel train 45, a main plate 55, a wheel train holder 56, and a dial 59.

The hour-minute wheel train 41 is a train of wheels that transfers drive power from the hour-minute motor 12*a* to the hour hand 11*a* and minute hand 11*b*.

The seconds wheel train 45 is a train of wheels that transfers drive power from the seconds motor 12*b* to the second hand 11*c*.

The pivots of the hour-minute motor 12*a*, seconds motor 12*b*, hour-minute wheel train 41, and seconds wheel train 45 are supported parallel to each other by the main plate 55 and wheel train holder 56, for example.

For example, when the indicator 11 is defined as the hour hand 11*a* or minute hand 11*b*, the drive module 10 is defined as an hour-minute module including the hour-minute motor 12*a*, hour-minute wheel train 41, hour hand 11*a*, and minute hand 11*b*. If the indicator 11 is defined as the second hand 11*c*, the drive module 10 is defined as a seconds module including the seconds motor 12*b*, seconds wheel train 45, and second hand 11*c*.

The hour-minute wheel train 41 includes an intermediate wheel 42 that is driven by the hour-minute rotor 121*a*; a minute hand intermediate wheel (third wheel) and pinion 43 that is driven by the intermediate wheel 42; a minute hand wheel (second wheel) and pinion 44 that is driven by the minute hand intermediate wheel (third wheel) and pinion 43; and a hour hand wheel and pinion 48 that is driven by the minute hand wheel and pinion 44 through a minute wheel and pinion not shown.

The intermediate wheel 42 comprises an intermediate wheel that meshes with the pinion of the hour-minute rotor 121*a*, and an intermediate pinion with a diameter that is smaller than the intermediate wheel 42.

The minute hand intermediate wheel (third wheel) and pinion 43 includes a minute hand intermediate wheel that meshes with the intermediate pinion, and a minute hand intermediate pinion with a diameter that is smaller than the minute hand intermediate wheel.

The minute hand wheel and pinion 44 includes a minute hand wheel that meshes with the minute hand intermediate pinion, a minute hand pinion that meshes with the minute wheel, and a minute hand pivot 52 to which the minute hand 11*b* is attached. The minute hand wheel and pinion 44 rotates in unison with the minute hand 11*b* on the minute display cycle.

The hour hand wheel and pinion 48 includes an hour hand wheel that meshes with the pinion of the minute wheel, and an hour hand pivot 51 to which the hour hand 11*a* is attached. The hour hand wheel and pinion 48 rotates in unison with the hour hand 11*a* on the hour display cycle. The hour hand 11*a* and minute hand 11*b* are thus driven together in this embodiment.

The first detector 20*a* includes a first light source 21*a* and a first light sensor 22*a*. The first light source 21*a* and first light sensor 22*a* are disposed in mutual opposition in the direction of the wheel pivots with the hour hand wheel and pinion 48, main plate 55, minute hand wheel and pinion 44, and minute hand intermediate wheel and pinion 43 therebetween.

The first light source 21*a* is disposed on the surface of a first support 551, which is disposed adjacent to the dial 59 side of the hour hand wheel of the hour hand wheel and pinion 48.

The first light sensor 22*a* is disposed on the surface of the second support 552, which is disposed adjacent to the wheel train holder 56 side of the minute hand intermediate wheel of the minute hand intermediate wheel and pinion 43 in this example The main plate 55 has a main plate window 550 through which light emitted from the first light source 21*a* passes to the first light sensor 22*a*. The main plate window 550, first light source 21*a*, and first light sensor 22*a* are therefore disposed stacked in plan view as seen from the axial direction.

The hour hand wheel and pinion 48 has an hour hand window 480 through which light passes and which is disposed to the hour hand wheel.

The minute hand wheel and pinion 44 has a minute hand window 440 through which light passes and which is disposed to the minute hand wheel.

The minute hand intermediate wheel and pinion 43 has a minute hand intermediate window 430 through which light passes and which is disposed to the minute hand intermediate wheel.

The main plate window 550, hour hand window 480, minute hand window 440, and minute hand intermediate window 430 in this example are through-holes through the axial direction.

The hour-minute wheel train 41 is disposed so that when, for example, the hour hand 11*a* and minute hand 11*b* are at the 12:00 position indicating 00:00 or 12:00, the hour hand window 480, minute hand window 440, and minute hand intermediate window 430 are aligned in plan view from the axial direction with the main plate window 550. In other words, when the hour hand 11*a* and minute hand 11*b* are at the 12:00 position, that is, the reference position, the first light sensor 22*a* selectively senses light emitted from the first light source 21*a* and passing through the through-hole.

The seconds wheel train 45 includes a second hand intermediate wheel (fifth wheel) and pinion 46 that is driven by the seconds motor 12*b*, and a second hand wheel (fourth wheel) 47 that is driven by the second hand intermediate wheel and pinion 46.

The second hand intermediate wheel and pinion 46 includes a second hand intermediate wheel that meshes with the pinion of the seconds rotor 121*b*, and a second hand intermediate pinion with a diameter that is smaller than the second hand intermediate wheel.

The second hand wheel and pivot 47 includes a second hand wheel that meshes with the second hand intermediate pinion, and a second hand pivot 53 to which the second hand 11*c* attaches. The second hand wheel and pivot 47 rotates in unison with the second hand 11*c* on the seconds display cycle.

The second detector 20*b* includes a second light source 21*b* and a second light sensor 22*b*. The second light source 21*b* and second light sensor 22*b* are disposed, for example, in mutual opposition along the axial direction with the second hand wheel and pivot 47 therebetween.

The second light source 21*b* is disposed, for example, on the surface of the second support 552, which is disposed adjacent to the dial 59 side of the second hand wheel of the second hand wheel and pivot 47.

The second light sensor 22*b* is disposed, for example, on the surface of the wheel train holder 56 with a circuit board not shown therebetween.

The second hand wheel and pivot 47 has a second hand window 470 through which light passes and which is disposed to the second hand wheel. The second hand window 470 is a through-hole passing through the axial direction, for example. The seconds wheel train 45 is disposed so that when the second hand 11*c* is at the 12:00 position, that is, at the zero second of the minute, the second hand window 470 is aligned in plan view along the axial direction with the second light source 21*b* and second light sensor 22*b*. In other words, when the second hand is at the 12:00 position, that is, the reference position, the second light sensor 22*b* senses light emitted from the second light source 21*b* and passing through the through-hole.

In the configuration described above, the indicator position detector 20 shown in FIG. 1 may be the first detector 20*a* or the second detector 20*b*.

For example, when the indicator 11 is defined as the hour hand 11*a* or minute hand 11*b*, the indicator position detector 20 is defined as the first detector 20*a*, and the light emitter 21 and photodetector 22 are defined as the first light source 21*a* and first light sensor 22*a*, respectively.

When the indicator 11 is defined as the second hand 11*c*, the indicator position detector 20 is defined as the second detector 20*b*, and the light emitter 21 and photodetector 22 are defined as the second light source 21*b* and second light sensor 22*b*, respectively.

Control Circuit Operation

Figure 4:
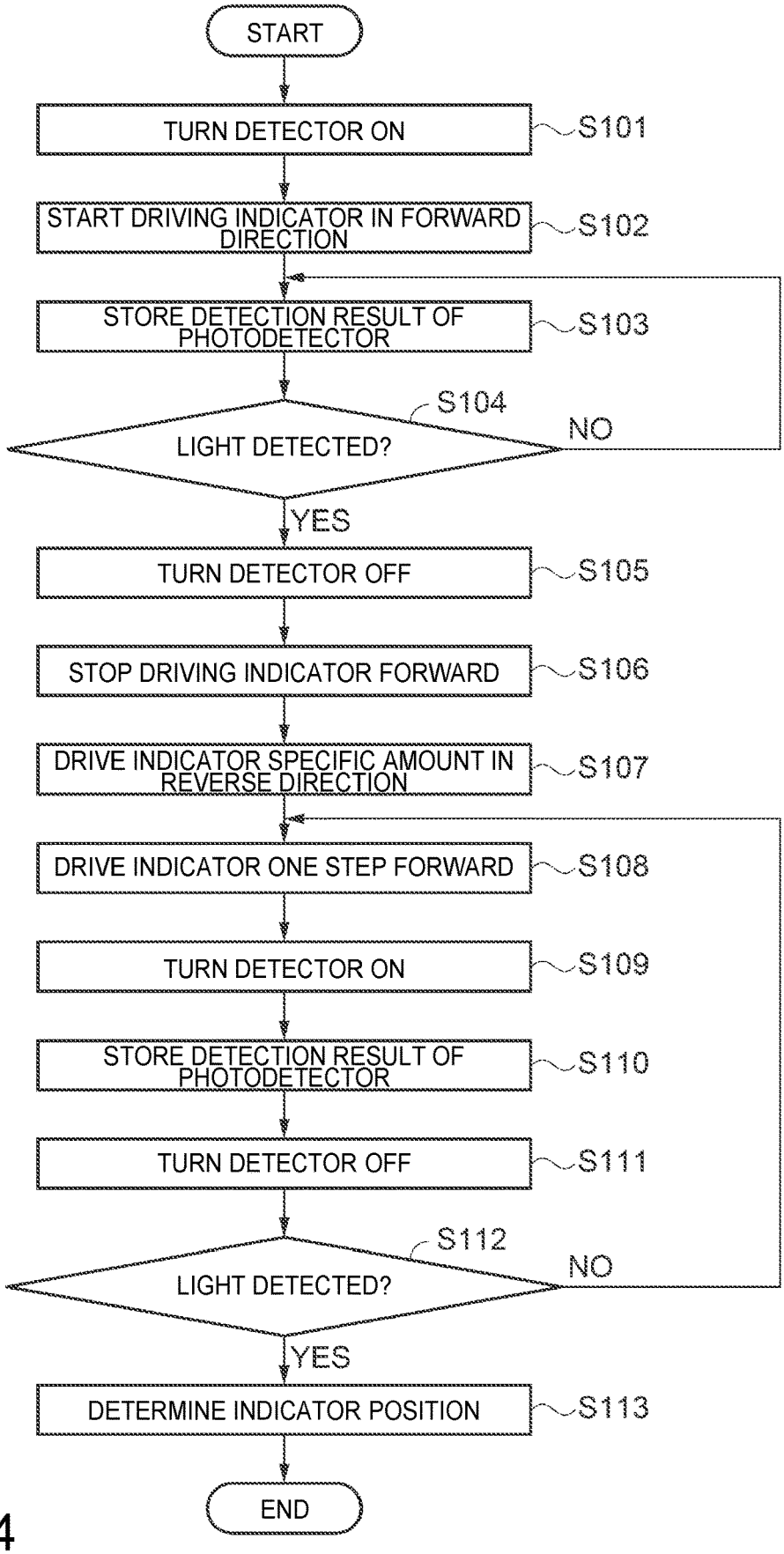
FIG. 4 is a flow chart shows an example of the indicator position detection method of the electronic timepiece according to the first embodiment.

The operation of the control circuit 35 is described below with reference to the flow chart in FIG. 4 as an example of the indicator position detection method of the electronic timepiece 1 according to the first embodiment. The steps of the process shown in the flow chart in FIG. 4 are executed as an initialization operation when the system is reset, for example. The process described in the example below uses the minute hand 11*b* shown in FIG. 3 as the indicator 11, the hour-minute motor 12*a* as the actuator 12, and the first detector 20*a* as the indicator position detector 20.

First, in step S101, the processor 36 starts the process in the first mode, and turns the first detector 20*a* on through the detector driver 37. More specifically, the detector driver 37 turns the first light source 21*a* on to start emitting by supplying power to the first light source 21*a*.

In step S102, the processor 36, through the indicator driver 38, starts driving the minute hand 11*b* in the forward direction, that is, clockwise. The indicator driver 38 drives the minute hand 11*b* continuously in one direction by outputting a drive signal to the hour-minute motor 12*a* and driving the hour-minute rotor 121*a*.

Note that "continuously" as used herein means that driving the minute hand 11*b* and causing the first light source 21*a* to emit do not alternate, but are actually continuous (uninterrupted).

In step S103, the processor 36 stores the detection signal input from the first light sensor 22*a* through the detector driver 37 in the storage 39. Note that step S103 is executed multiple times at a specific sampling frequency, but the storage 39 does not need to store a history of all detection results, and may cyclically store the detection results at the sampling frequency.

In step S104, the processor 36 references the detection results most recently stored in the storage 39 in step S103, and determines whether or not the first light sensor 22*a* detected the light emitted from the first light source 21*a*. If the processor 36 determines light was detected, control goes to step S105; if the processor 36 determines light was not detected, control returns to step S103.

In step S105, the processor 36 turns the first detector 20*a* off through the detector driver 37. More specifically, the detector driver 37 stops light emission by the first light source 21*a* by stopping supplying power to the first light source 21*a*.

In step S106, the processor 36, through the indicator driver 38, stops driving the minute hand 11*b* in the forward direction, which started in step S102. More specifically, the indicator driver 38 stops driving the minute hand 11*b* by stopping output of the drive signal to the hour-minute motor 12*a* and stopping driving the hour-minute rotor 121*a*. As a result, the processor 36 ends the process in the first mode.

In step S107, the processor 36 drives the minute hand 11*b* a specific amount in the reverse direction, that is, counterclockwise in this example, through the indicator driver 38. When the minute hand 11*b* is driven the specific amount, the processor 36 goes to the second mode. Because a delay results from the interrupt process of the CPU after light is detected in step S104 until driving the minute hand 11*b* is stopped by the operation of step S106, the minute hand 11*b* stops at a position past the reference position when the drive frequency of the hour-minute motor 12*a* exceeds a specific value. In response, the processor 36 drives the minute hand 11*b* in the reverse direction a specific number of steps, such as several ten steps. More specifically, the specific amount driven in step S107 is an amount in a specific range causing the minute hand 11*b* that stopped at a position in the forward direction past the reference position to move past the reference position in the reverse direction a specific amount from the reference position.

In step S108, the processor 36 starts the process of the second mode, and through the indicator driver 38 drives the minute hand 11*b* one step in the forward direction. More specifically, the indicator driver 38 outputs a drive signal to the hour-minute motor 12*a* to drive the hour-minute rotor 121*a* one step and thereby move the minute hand 11*b* forward.

In step S109, the processor 36 turns the first detector 20*a* on through the detector driver 37. More specifically, the detector driver 37 causes the first light source 21*a* to start emitting by supplying power to the first light source 21*a*.

In step S110, the processor 36 stores the detection signal input from the first light sensor 22*a* through the detector driver 37 as the detection result in the storage 39. Note that step S110 is executed multiple times at a specific sampling frequency, but the storage 39 does not need to store a history of all detection results, and may cyclically store the detection results at the sampling frequency.

In step S111, the processor 36 turns the first detector 20*a* off through the detector driver 37. More specifically, the detector driver 37 stops light emission by the first light source 21*a* by stopping supplying power to the first light source 21*a*.

In step S112, the processor 36 references the detection result most recently stored in the storage 39 in step S110, and determines whether or not the first light sensor 22*a* detected the light emitted from the first light source 21*a*. If the processor 36 determines light was detected, control goes to step S113; but if the processor 36 determines light was not detected, control returns to step S108.

Because the first detector 20*a* detected the minute hand 11*b* at the reference position, the processor 36 ends the process in step S113 because the indicator 11 was confirmed to be at the reference position.

Note that in the first embodiment as described above the minute hand 11*b* moves in conjunction with the hour hand 11*a*, and the reference positions of the hour hand 11*a* and minute hand 11*b* are defined as the position when indicating 00:00 or 12:00. Therefore, the control circuit 35 can also be thought of as controlling the hour-minute motor 12*a* and first detector 20*a*, and detecting the reference positions of two hands, the hour hand 11*a* as an example of a first indicator, and the minute hand 11*b* as an example of a second indicator.

As described above, in response to the first light sensor 22*a* detecting light in step S104 in the first mode, the control circuit 35 goes to the second mode when in step S107 the minute hand 11*b* is driven the specific amount in the reverse direction. The control circuit 35 alternately drives the minute hand 11*b* and causes the first light source 21*a* to emit in steps S108 and S109 in the second mode. As a result, the control circuit 35 can shorten the time from the start to the end of detecting the indicator 11 at the reference position.

Control in the First Mode

An example of the operation of the indicator driver 38 that drives the actuator 12 in the first mode is described below. In this example the hour-minute motor 12*a* is defined as the actuator 12.

Motor Configuration

An example of the configuration of the hour-minute motor 12*a*, which is the controlled object, is described next with reference to FIG. 5.

Figure 5:
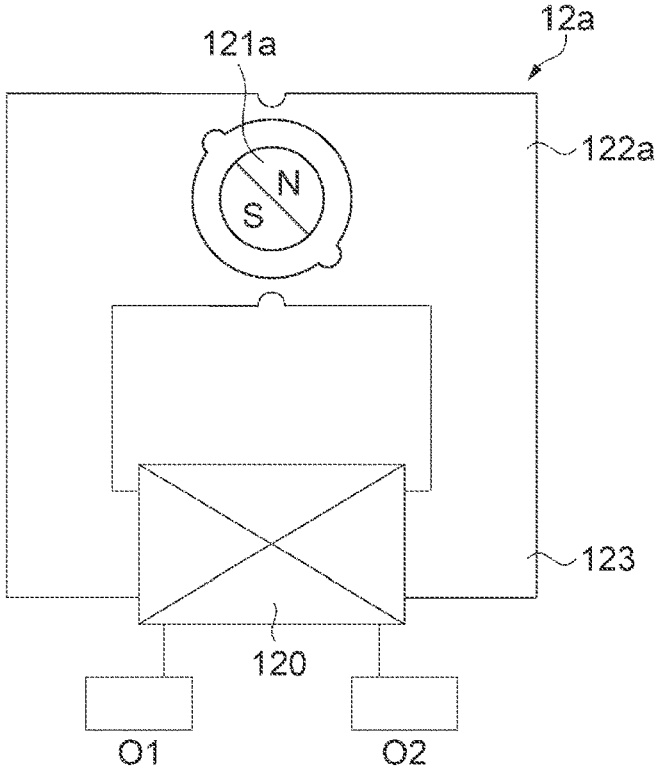
FIG. 5 illustrates the configuration of a stepper motor as an example of an actuator.

As shown in FIG. 5, the hour-minute motor 12*a* has, in addition to the hour-minute rotor 121*a* and hour-minute stator 122*a*, a core 123 connected to the hour-minute stator 122*a*, and a coil 120 wound around the core 123. The hour-minute rotor 121*a* is magnetized in the radial direction perpendicular to the axis. The hour-minute stator 122*a* and core 123 are both ferromagnets. The ends of the core 123 are respectively connected to the opposite ends of the hour-minute stator 122*a*. The ends of the coil 120 are respectively connected to the output terminals O1 and O2 of the indicator driver 38.

The hour-minute rotor 121*a* is disposed on the inside of a housing hole formed in the hour-minute stator 122*a*. The housing hole is round and centered on the axis of the hour-minute rotor 121*a* in a plan view looking along the axial direction of the hour-minute rotor 121*a*.

The hour-minute stator 122*a* has a pair of inside notches formed in mutual opposition in the inside wall of the housing hole, and a pair of outside notches formed facing in opposite directions in the direction perpendicular to the direction between the ends of the hour-minute stator 122*a*.

The inside notches of the hour-minute stator 122*a* define a stable position where the hour-minute rotor 121*a* stops and is stable.

The outside notches of the hour-minute stator 122*a* define an area where magnetic resistance is greater than at other places when the hour-minute stator 122*a* is energized by the coil 120.

The coil 120 produces magnetic flux in the core 123 when current flows from the indicator driver 38 in one direction, creating a pair of magnetic poles in the hour-minute stator 122*a*. As a result, the hour-minute rotor 121*a* having a pair of magnetic poles turns one step, that is, turns 180°. When the current flows through the coil 120 in the opposite direction, the magnetic poles of the hour-minute stator 122*a* reverse. As a result, the hour-minute rotor 121*a* turns one step again.

Configuration of the Indicator Driver

Figure 6:
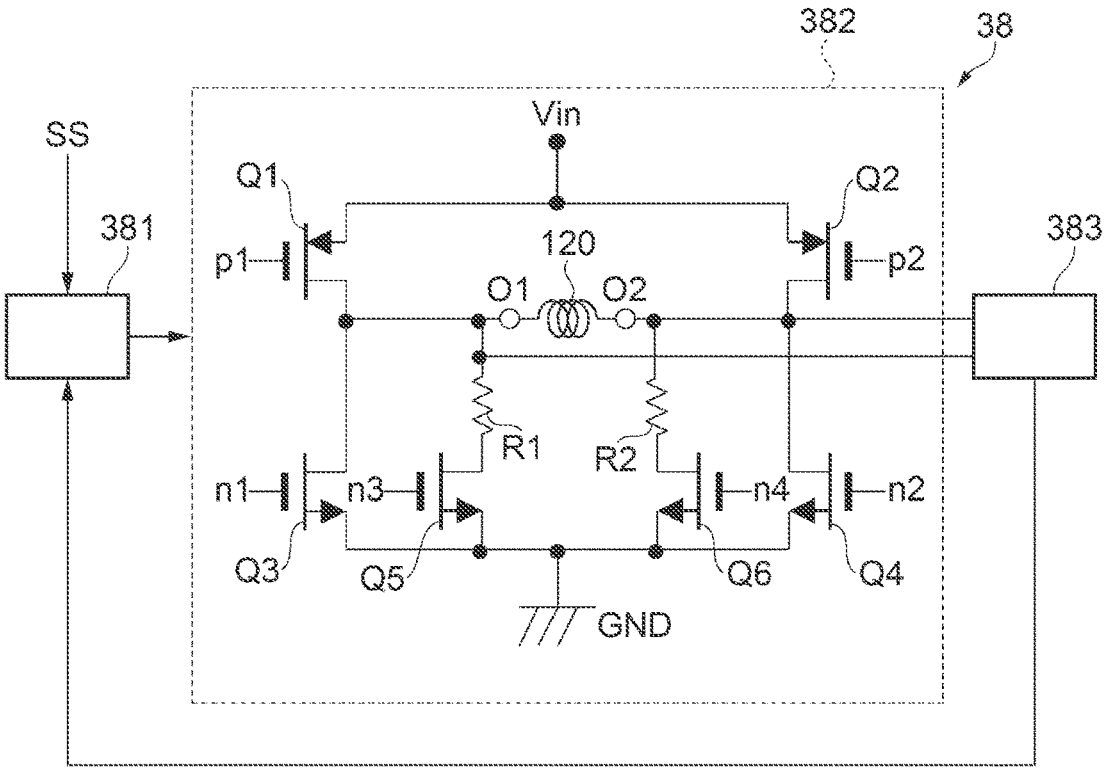
FIG. 6 illustrates the configuration of an indicator driver based on a circuit diagram of the drive circuit.

An example of the configuration of the indicator driver 38 is described next with reference to FIG. 6. As shown in FIG. 6, the indicator driver 38 includes a drive control circuit 381, drive circuit 382, and current detection circuit 383.

The drive control circuit 381 outputs a switching signal to the drive circuit 382 in response to a setting signal SS output from the processor 36.

The drive circuit 382 outputs a drive signal to the coil 120 of the hour-minute motor 12*a* in response to the switching signal input from the drive circuit 382.

The current detection circuit 383 detects the current flow through the coil 120, and outputs a detection signal corresponding to the detected current to the drive control circuit 381.

In the example in FIG. 6, the drive circuit 382 has switching elements Q1 and Q2, which are two p-channel transistors; switching elements Q3 to Q6, which are four re-channel transistors; and two detection resistors R1 and R2.

One primary electrode of switching element Q1 is connected to the input voltage Vin, and the other primary electrode is connected to the output terminal O1.

One primary electrode of switching element Q2 is connected to the input voltage Vin, and the other primary electrode is connected to the output terminal O2.

One primary electrode of switching element Q3 is connected to output terminal O1, and the other primary electrode is connected to ground potential GND.

One primary electrode of switching element Q4 is connected to output terminal O2, and the other primary electrode is connected to ground potential GND.

One primary electrode of switching element Q5 is connected to output terminal O1 through detection resistor R1, and the other primary electrode is connected to ground potential GND.

One primary electrode of switching element Q6 is connected to output terminal O1 through detection resistor R2, and the other primary electrode is connected to ground potential GND.

The respective control electrodes of the six switching elements Q1 to Q6 connect to the drive control circuit 381. The control electrodes in this example are gate electrodes, and are electrodes that control the current flow through a pair of primary electrodes. The switching elements Q1 to Q6 are controlled by switching signals p1, p2, n1, n2, n3, and n4 input from the drive control circuit 381 to the control electrodes. In this way the drive circuit 382 outputs drive signals, which are current signals, to the stepper motors using multiple switching elements.

The current detection circuit 383 detects the current flow through the coil 120 by detecting the signals output from the output terminals O1 and O2. For example, by comparing the voltage at the ends of the detection resistors R1 and R2 with a reference voltage, the current detection circuit 383 determines whether or not the current Ic flow through the coil 120 is less than a minimum current Imin, and whether or not the current Ic is greater than a maximum current Imax. The current detection circuit 383 outputs a detection signal indicating the evaluation result to the drive control circuit 381.

Operation of the Indicator Driver

An example of the operation of the indicator driver 38 in the first mode is described next with reference to FIG. 7. By the processor 36 starting the process of the first mode, the indicator driver 38 starts continuously driving the hour-minute motor 12*a* in one direction in response to the first light source 21*a* starting to emit.

At time t1, the drive control circuit 381 controls the drive circuit 382 to an on state supplying current in the positive direction to the coil 120. The positive direction in this example is the direction in which current flows through the winding of the coil 120 from output terminal O1 to output terminal O2. The drive control circuit 381 outputs Low level switching signals p1, n1, n2 and n3, and High level switching signals p2 and n4, to the drive circuit 382. As a result, switching element Q1 and switching element Q6 turn on, and switching elements Q2, Q3, Q4 and Q5 turn off. As a result, current flows sequentially through switching element Q1, output terminal O1, coil 120, output terminal O2, detection resistor R2, and switching element Q6.

Figures 7, 8:
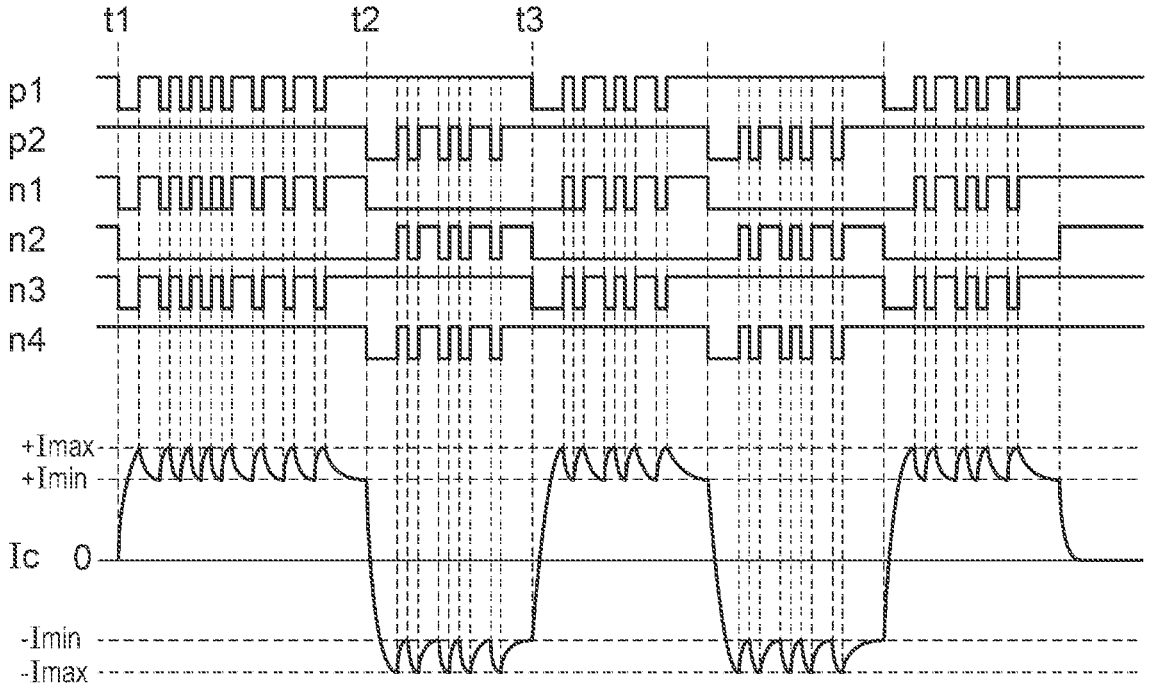
FIG. 7 is a timing chart describing the operation of the drive circuit.
FIG. 8 is a table showing the detection times when the actuator is driven continuously.

As a result, as shown in FIG. 7, the current Ic flow through the coil 120 increases over time from time t1 due to the counter-electromotive force. When the current Ic becomes greater than the positive maximum current Imax, the current detection circuit 383 outputs to the drive control circuit 381 a detection signal indicating the current Ic exceeded the maximum current Imax in the positive direction.

In response to a detection signal indicating the current Ic exceeds the maximum current Imax, the drive control circuit 381 sets the drive circuit 382 to an off state stopping supplying current in the positive direction. The drive control circuit 381 outputs Low level switching signal n2, and igh level switching signals p1, p2, n1, n3 and n4 to the drive circuit 382. As a result, switching elements Q3, Q5 and Q6 turn on, and switching elements Q1, Q2 and Q4 turn off. Both ends of the coil 120 are isolated from the input voltage Vin, and respectively connect to the ground potential GND through detection resistors R1 and R2. As a result, the current Ic decreases over time due to the counter-electromotive force from when the current Ic exceeds maximum current Imax.

When the current Ic becomes lower than the positive minimum current Imin, the current detection circuit 383 outputs to the drive control circuit 381 a detection signal indicating the current Ic exceeds the minimum current Imin in the negative direction.

The drive control circuit 381 turns the drive circuit 382 to an on state supplying current in the positive direction to the coil 120 in response to a detection signal indicating the current Ic exceeded the minimum current Imin in the negative direction. In this way, by alternately switching between an on state and an off state from time t1 to time t2, the drive control circuit 381 applies rated current control to the hour-minute motor 12*a* so that current Ic remains in a range between a positive maximum current Imax and minimum current Imin.

At time t2, the drive control circuit 381 changes the polarity of the voltage supplied to the coil 120. More specifically, the drive control circuit 381 controls the drive circuit 382 to an on state supplying current in the negative direction to the coil 120. The drive control circuit 381 outputs Low level switching signals p2, n1, n2 and n4, and High level switching signals p1 and n3, to the drive control circuit 381. As a result, switching elements Q2 and Q5 turn on, and switching elements Q1, Q3, Q4 and Q6 turn off. Current therefore flows sequentially from switching element Q2 to output terminal O2, coil 120, output terminal O1, detection resistor R1, and switching element Q5.

As shown in FIG. 7, this causes the current Ic flowing through the coil 120 to decrease over time from time t2 due to the counter-electromotive force. The direction of the current Ic therefore reverses, and when current Ic becomes lower than negative maximum current −Imax, when the direction of the current Ic reverses and the current Ic goes lower than the negative maximum current −Imax, the current detection circuit 383 outputs to the drive control circuit 381 a detection signal indicating that the current Ic exceeded the maximum current −Imax in the negative direction.

The drive control circuit 381 turns the drive circuit 382 to an off state stopping supplying current in the negative direction in response to a detection signal indicating the current Ic exceeded the maximum current −Imax in the negative direction.

The drive control circuit 381 then outputs to the drive circuit 382 a Low level switching signal n1 and High level switching signals p1, p2, n2, n3 and n4. As a result, switching elements Q4, Q5 and Q6 turn on, and switching elements Q1, Q2 and Q3 turn off. The ends of the coil 120 are therefore isolated from the input voltage Vin, and are respectively connected to the ground potential GND through detection resistors R1 and R2.

As a result, the current Ic decreases over time due to the counter-electromotive force from the time current Ic exceeds maximum current −Imax in the negative direction. When current Ic becomes greater than negative minimum current −Imin, the current detection circuit 383 outputs to the drive control circuit 381 a detection signal indicating that current Ic exceeded the minimum current −Imin in the positive direction.

In response to the detection signal indicating current Ic exceeded the minimum current −Imin in the positive direction, the drive control circuit 381 sets the drive circuit 382 to an on state supplying current in the negative direction to the coil 120. By alternately switching between an on state and an off state from time t2 to time t3, the drive control circuit 381 applies rated current control to the hour-minute motor 12*a* so that current Ic is in the range from negative maximum current −Imax and minimum current −Imin.

By the drive control circuit 381 executing the process from time t1 to time t3, the hour-minute rotor 121*a* turns two steps, that is, 360°. By the drive control circuit 381 executing the process from time t1 to time t3 cyclically, the indicator driver 38 can output to the hour-minute motor 12*a* a drive signal with a specific drive frequency.

The indicator driver 38 can also estimate the angular displacement of the hour-minute rotor 121*a* by detecting the induced current flowing due to the free vibration of the hour-minute rotor 121*a* from the current Ic flowing through the coil 120. The indicator driver 38 can cause the hour-minute rotor 121*a* to rotate by controlling on state and off state times of the drive circuit 382 in response to the estimated angular displacement. Because the indicator driver 38 can cause the hour-minute rotor 121*a* to rotate without stopping every step, the indicator 11 can be driven at a high speed.

As a result, the time from the start to the end of indicator position detection in the first mode can be shortened. By controlling the power supplied to the coil 120 according to the angular displacement of the hour-minute rotor 121*a*, the indicator driver 38 can cause the hour-minute rotor 121*a* to turn in both directions.

Note that in the second mode, the indicator driver 38 controls the on state and off state times of the drive circuit 382 to turn the rotor one step at a time.

Note also that the indicator driver 38 is not limited to rated current control of the stepper motor in the first mode. For example, the processor 36 may drive the stepper motor by outputting a fixed pulse previously set so that the stepper motor turns 180 degrees. In this case, the indicator 11 can be driven quickly by setting the drive frequency in the first mode higher than the drive frequency of the drive signal used for rotation in the normal time display period. In this case the time from starting to stopping indicator position detection can be shortened by driving the indicator 11 continuously while the light emitter 21 is emitting in the first mode.

Detection Time

When the hour hand 11*a* and minute hand 11*b* that indicate the time are driven by the same hour-minute motor 12*a*, and the hour-minute motor 12*a* is driven one step every five seconds, the number of steps the hour-minute motor 12*a* is driven in one cycle of the hour hand 11*a*, that is, in 12 hours, is 8640 steps. When driving the hour-minute motor 12*a* and driving the first light source 21*a* alternate to detect the indicator position, the total detection time, which is the maximum time required for detection, when the drive frequency of the hour-minute motor 12*a* is 30 Hz is (1/30)×8640 or 288 seconds.

FIG. 8 is a table showing the total detection time required to detect the hour hand 11*a* and minute hand 11*b* at the reference position in the first mode at various drive frequencies.

As described above, the total detection time when the drive frequency is 30 Hz is 288 seconds.

When the drive frequency is 85.3 Hz, the total detection time is (1/85.3)×8640 or 101 seconds. One example of the maximum drive frequency at which the hour-minute motor 12*a* can be desirably driven by a previously set fixed pulse instead of by rated current control is 85.3 Hz.

When the drive frequency is 250 Hz, the total detection time is 34.56 seconds.

When the drive frequency is 500 Hz, the total detection time is 17.28 seconds.

Compared with alternately driving the hour hand 11*a* and minute hand 11*b* and driving the first light source 21*a*, driving the hour hand 11*a* and minute hand 11*b* continuously while driving the light emitter 21 to emit can therefore detect the indicator position in a shorter maximum detection time.

As described above, the time from starting to completing detection may be longer when the indicator position is detected by alternately driving the hour hand 11*a* and minute hand 11*b* and driving the first light source 21*a*. However, the control circuit 35, in the first mode, continuously drives the hour-minute motor 12*a* in one direction while the first light source 21*a* is emitting until the hour hand 11*a* and minute hand 11*b* are detected at the reference position.

The control circuit 35 goes to the second mode after driving the hour-minute motor 12*a* a specific amount in the reverse direction when the first light sensor 22*a* detects light. In the second mode, the control circuit 35 detects the indicator position more accurately than in the first mode by alternating driving the hour-minute motor 12*a* and driving the first light source 21*a* to emit. As a result, because the time required for detection in the second mode can be shortened, the electronic timepiece 1 can shorten the time from the start to the end of indicator position detection.

Variations

Figure 9:
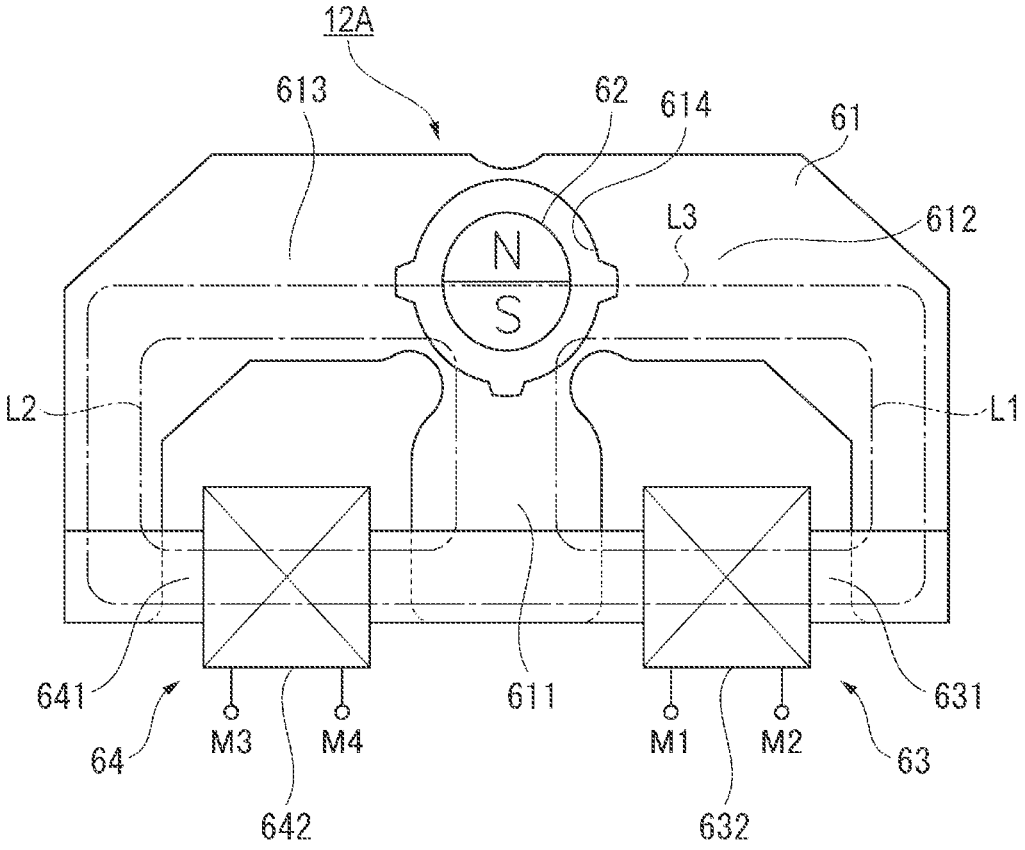
FIG. 9 describes a stepper motor having two coils as an example of an actuator according to a variation of the first embodiment.

The first embodiment describes an example using a hour-minute motor 12*a* with a single coil 120 as the actuator 12. The actuator 12 may obviously be a stepper motor having two coils, for example. More specifically, as shown in FIG. 9, the actuator in one variation of the first embodiment is a motor 12A having a stator 61, rotor 62, first coil block 63, and a second coil block 64.

The stator 61 has a first yoke 611, second yoke 612, and third yoke 613, which are ferromagnets. The second yoke 612 and third yoke 613 are connected together to be continuous in one direction.

The first yoke 611 is further connected perpendicularly to the second yoke 612 and third yoke 613 at a location connecting the second yoke 612 and third yoke 613 together.

The stator 61 is disposed to a position connecting the first yoke 611, second yoke 612 and third yoke 613 together, and has a housing hole 614 in which the rotor 62 is disposed. In a plan view looking along the axial direction of the rotor 62, the housing hole 614 is round and centered on the axis of the rotor 62.

The stator 61 has three inside notches formed in the inside surface of the housing hole 614 at positions opposite the first yoke 611, second yoke 612 and third yoke 613. Of the three inside notches, the two mutually opposing internal notches corresponding to the second yoke 612 and third yoke 613 define a stable position where the rotor 62 magnetized in the radial direction stops and is stable.

The stator 61 also has three outside notches disposed to the positions where the first yoke 611, second yoke 612 and third yoke 613 are connected together. The three outside notches define an area where, by narrowing the width of the first yoke 611, second yoke 612 and third yoke 613 near the housing hole 614, the magnetic resistance is greater than other locations when the stator 61 is energized.

The first coil block 63 includes a first core 631 formed by a ferromagnet, and a first coil 632 wound around the first core 631.

At the ends of the first coil 632 are input terminals M1 and M2 respectively connected to an output terminal not shown of the indicator driver 38. The first coil 632 is wound in the direction producing magnetic flux clockwise in FIG. 9 in a loop L1 formed by the first core 631, first yoke 611, and second yoke 612 when current flows from input terminal M1 to input terminal M2, for example.

The second coil block 64 includes a second core 641 that is a ferromagnet and connects to the first core 631, and a second coil 642 wound around the second core 641. The ends of the second core 641 are respectively connected to the first yoke 611 and third yoke 613. The second core 641 need not be connected to the first core 631.

The second coil 642 has input terminals M3 and M4 respectively connected to the output terminal not shown of the indicator driver 38. The second coil 642 is wound in the direction producing magnetic flux clockwise in FIG. 9 in a loop L2 formed by the second core 641, first yoke 611, and third yoke 613 when current flows from input terminal M3 to input terminal M4, for example.

By controlling the current flowing to the first coil 632 and separate second coil 642, the first yoke 611, second yoke 612 and third yoke 613 produce on the housing hole 614 side thereof magnetic poles that act on the rotor 62. As a result, the rotor 62 can be made to turn in both directions as controlled by the indicator driver 38.

Counterclockwise Rotation

Figure 10:
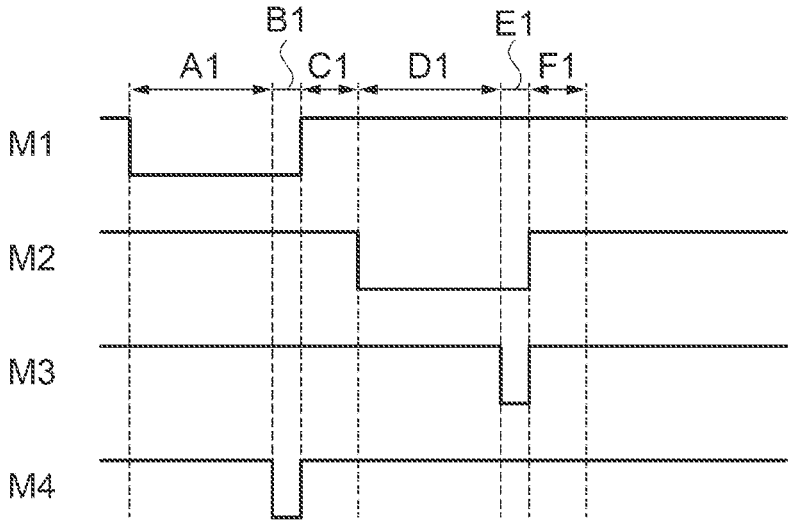
FIG. 10 is a timing chart describing a drive signal that causes the stepper motor in FIG. 9 to turn counterclockwise.

The rotor 62 turns counterclockwise as seen in FIG. 9 by inputting drive signals such as shown in FIG. 10 to input terminals M1 to M4.

First, in period A1 in FIG. 10, the indicator driver 38 outputs a Low level drive signal to input terminal M1, and outputs a High level drive signal to input terminals M2 to M4. Because current flows from input terminal M2 to input terminal M1 through the first coil 632 at this time, magnetic flux moving counterclockwise as seen in FIG. 9 is produced. The housing hole 614 side of the second yoke 612 therefore becomes the north pole, and the housing hole 614 side of the first yoke 611 becomes the south pole. Magnetic flux travelling counterclockwise is also produced in a third loop L3 comprising the first core 631, second core 641, second yoke 612 and third yoke 613. As a result, the housing hole 614 side of the third yoke 613 becomes a south pole. The rotor 62 therefore turns counterclockwise from the initial state shown in FIG. 9.

In the next period B1, the indicator driver 38 outputs a Low level drive signal to the input terminal M4. Because current flows at this time from input terminal M3 to input terminal M4 through second coil 642, new clockwise magnetic flux is produced in loop L2 while magnetic flux flowing counterclockwise in FIG. 9 is produced in loop L1. The housing hole 614 side of the second yoke 612 and third yoke 613 become north poles, the housing hole 614 side of the first yoke 611 becomes a south pole, and the rotor 62 therefore stops with the north pole on the first yoke 611 side. As a result, the rotor 62 that turned counterclockwise stops at a stable position 180° from the initial position.

In the next period C1, the indicator driver 38 outputs a High level drive signal to input terminals M1 and M4. Because current does not flow through the first coil 632 and second coil 642, magnetic polarization of the stator 61 is cancelled.

In the next period D1, the indicator driver 38 outputs a Low level drive signal to input terminal M2. Because current flows through the first coil 632 from input terminal M1 to input terminal M2 at this time, magnetic flux moving clockwise in FIG. 9 is produced in loop L1.

As a result, the housing hole 614 of the second yoke 612 becomes the south pole, and the housing hole 614 side of the first yoke 611 becomes the north pole. Clockwise magnetic flux therefore occurs in loop L3. As a result, the housing hole 614 side of the third yoke 613 becomes the north pole. The rotor 62 rotated 180° from the initial position therefore turns further counterclockwise.

In the next period E1, the indicator driver 38 outputs a Low level drive signal to input terminal M3. Because current flows from input terminal M4 to input terminal M3 through the second coil 642 at this time, new counterclockwise magnetic flux is produced in loop L2 while magnetic flux going clockwise in FIG. 9 is produced in loop L1. Because the housing hole 614 side of the second yoke 612 and third yoke 613 become south poles, and the housing hole 614 side of the first yoke 611 becomes a north pole, the rotor 62 stops with the south pole near the first yoke 611 side. As a result, the rotor 62 that turned counterclockwise stops stably at a position 360° degrees from the initial position.

In the next period F1, the indicator driver 38 outputs a High level drive signal to input terminals M2 and M3. Because current does not flow through the first coil 632 and second coil 642, magnetic polarization of the stator 61 is cancelled. The rotor 62 turns two steps, that is, 360°, because the indicator driver 38 outputs drive signals as shown in periods A1 to F1 in FIG. 10.

Clockwise Rotation

Figure 11:
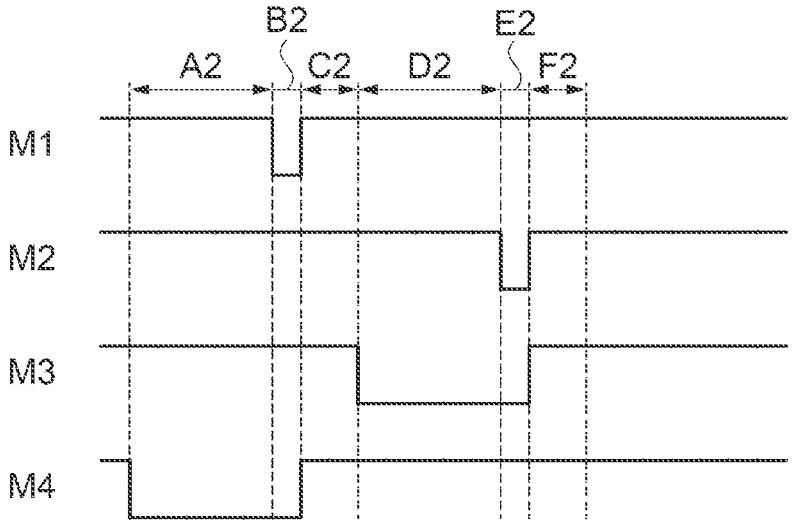
FIG. 11 is a timing chart describing a drive signal that causes the stepper motor in FIG. 9 to turn clockwise.

The rotor 62 turns clockwise as seen in FIG. 9 by inputting drive signals such as shown in FIG. 11 to input terminals M1 to M4.

First, in period A2 in FIG. 11, the indicator driver 38 outputs a Low level drive signal to input terminal M4, and outputs a High level drive signal to input terminals M1 to M3. Because current flows from input terminal M3 to input terminal M4 through the second coil 642 at this time, magnetic flux moving clockwise as seen in FIG. 9 is produced. The housing hole 614 side of the third yoke 613 therefore becomes the north pole, and the housing hole 614 side of the first yoke 611 becomes the south pole. Magnetic flux travelling clockwise is also produced in a loop L3. As a result, the housing hole 614 side of the first yoke 611 becomes a south pole. The rotor 62 therefore turns clockwise from the initial state shown in FIG. 9.

In the next period B2, the indicator driver 38 outputs a Low level drive signal to the input terminal M1. Because current flows at this time from input terminal M2 to input terminal M1 through first coil 632, new counterclockwise magnetic flux is produced in loop L1 while magnetic flux flowing clockwise in FIG. 9 is produced in loop L2. The housing hole 614 side of the second yoke 612 and third yoke 613 become north poles, the housing hole 614 side of the first yoke 611 becomes a south pole, and the rotor 62 therefore stops with the north pole near the first yoke 611 side. As a result, the rotor 62 that turned clockwise stops at a stable position 180° from the initial position.

In the next period C2, the indicator driver 38 outputs a High level drive signal to input terminals M1 and M4. Because current does not flow through the first coil 632 and second coil 642, magnetic polarization of the stator 61 is cancelled.

In the next period D2, the indicator driver 38 outputs a Low level drive signal to input terminal M3. Because current flows through the second coil 642 from input terminal M4 to input terminal M3 at this time, magnetic flux moving counterclockwise in FIG. 9 is produced in loop L2.

As a result, the housing hole 614 of the third yoke 613 becomes the south pole, and the housing hole 614 side of the first yoke 611 becomes the north pole. Counterclockwise magnetic flux therefore occurs in loop L3. As a result, the housing hole 614 side of the housing hole 614 becomes the north pole. The rotor 62 rotated 180° from the initial position therefore turns further clockwise.

In the next period E2, the indicator driver 38 outputs a Low level drive signal to input terminal M2. Because current flows from input terminal M1 to input terminal M2 through the first coil 632 at this time, new clockwise magnetic flux is produced in loop L1 while magnetic flux flowing counterclockwise in FIG. 9 is produced in loop L2. Because the housing hole 614 side of the second yoke 612 and third yoke 613 become south poles, and the housing hole 614 side of the first yoke 611 becomes a north pole, the rotor 62 stops with the south pole near the first yoke 611 side. As a result, the rotor 62 that turned clockwise stops stably at a position 360° degrees from the initial position.

In the next period F2, the indicator driver 38 outputs a High level drive signal to input terminals M2 and M3. Because current does not flow through the first coil 632 and second coil 642, magnetic polarization of the stator 61 is cancelled. The rotor 62 therefore turns two steps, that is, 360°, because the indicator driver 38 outputs drive signals as shown in periods A2 to F2 in FIG. 11.

Configuration for Reducing Power Consumption

A configuration for reducing power consumption by the processor circuit is described below. The processor 36, which is a processor circuit such as a CPU, control the time display by outputting a control signal to the indicator driver 38. More specifically, when an interrupt request signal corresponding to the internal time is input from the timekeeping circuit 33 to the processor 36, the processor circuit activates and outputs a control signal to the indicator driver 38. By the indicator driver 38 controlling the actuators according to the control signal, the hour hand 11*a*, minute hand 11*b*, and second hand 11*c* indicate the internal time kept by the timekeeping circuit 33. In addition, the processor 36 may also regularly execute other operations.

Figure 12:
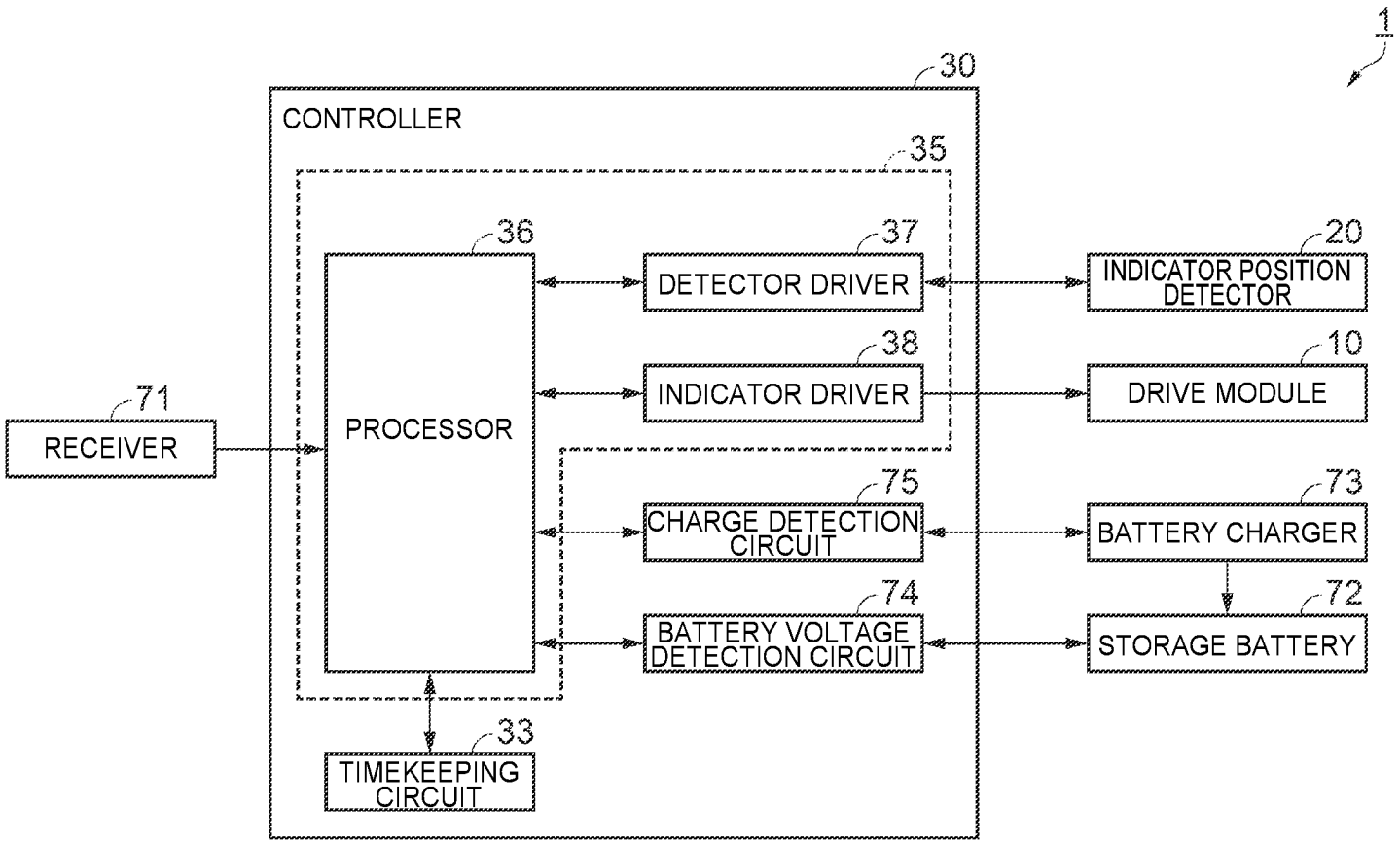
FIG. 12 is a block diagram illustrating another configuration of an electronic timepiece.

As shown in FIG. 12, the electronic timepiece 1 has a receiver 71, storage battery 72, battery charger 73, battery voltage detection circuit 74, and charge detection circuit 75.

The receiver 71 receives signals transmitted from satellites in a navigation (positioning) system such as the Global Positioning System (GPS) or Quasi-Zenith Satellite System (QZSS). The receiver 71 is configured, for example, by a processor circuit including an antenna. The receiver 71 may also be configured to time signals transmitted from a standard frequency and time signal service such as JJY in Japan. The receiver 71 extracts time and location information from the received radio signal.

The storage battery 72 is a rechargeable button battery or other type of storage battery.

The battery charger 73 is a power source that supplies power for charging the storage battery 72, and charges the storage battery 72. The battery charger 73 in one example of a solar cell. The battery charger 73 may be a power source that supplies power to the storage battery 72 by converting movement of the electronic timepiece 1 to current by electromagnetic induction.

The battery voltage detection circuit 74 detects the voltage of the storage battery 72 based on a control signal input from the processor 36 requesting battery voltage detection. The battery voltage detection circuit 74 then outputs a signal indicating the detected voltage to the processor 36.

The charge detection circuit 75 detects the charge state of power supplied to the storage battery 72 in response to a control signal input from the processor 36 requesting charge detection. The charge detection circuit 75 then outputs a signal indicating the voltage to the processor 36.

Figure 13:
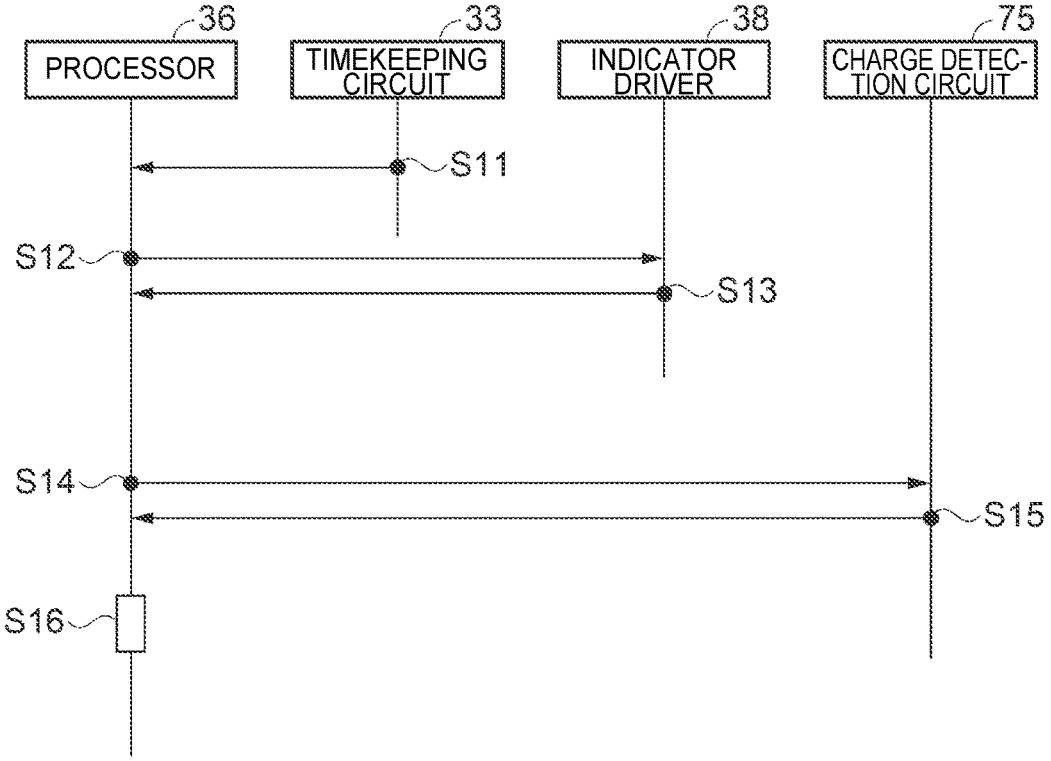
FIG. 13 is a sequence diagram describing an example of a process of the processor.

An example of the operation of the processor 36 when regularly detecting the charge state at a predetermined time is described below with reference to the sequence chart in FIG. 13. This example assumes that the timekeeping circuit 33 outputs an interrupt request signal to the processor 36 every five seconds based on the internal time. The processor 36 controls the time display by outputting a control signal to the indicator driver 38 to drive the hour-minute motor 12*a* one step each time an interrupt request signal is input. As a result, the hour hand 11*a* and minute hand 11*b* indicate the current time, which is the internal time.

First, in step S11, the timekeeping circuit 33 outputs an interrupt request signal to the processor 36.

In step S12, the processor 36 activates the processor circuit in response to the interrupt request signal output every five seconds, and outputs a control signal to the indicator driver 38 to drive the hour-minute motor 12*a* one step. The indicator driver 38 drives the hour hand 11*a* and minute hand 11*b* by driving the hour-minute motor 12*a* one step in response to the control signal.

In step S13, the indicator driver 38 outputs to the processor 36 a signal indicating that driving the hour-minute motor 12*a* was completed.

In step S14, the processor 36 outputs to the charge detection circuit 75 a control signal requesting charge detection. In response to the control signal, the charge detection circuit 75 detects the power supplied to the storage battery 72 as the charge state.

In step S15, the charge detection circuit 75 outputs to the processor 36 a signal indicating the detected charge state. The processor 36 stores the charge state in the storage 39 (see FIG. 1).

In step S16, the processor 36 determines, based on the charge state stored in the storage 39, whether or not to change the power supply mode from the normal mode to a power save mode. If the processor 36 determines to change the power mode, it goes to the power save mode, and if it determines to not change the power mode, continues in the normal mode and then stops the processor circuit that was activated in step S12.

The power save mode is a power supply mode in which power consumption is lower than the time display in the normal mode. The processor 36 suppresses power consumption in the power save mode by, for example, reducing the number of times the actuator 12 is driven or by pausing signal reception by the receiver 71. For example, the processor 36 may drive the second hand 11*c* every two seconds or more, or drive the minute hand 11*b* once a minute. The processor 36 may also drive the date indicator or day indicator once every 24 hours.

As described above, the processor 36 executes control of charge detection, which is an example of a function that executes at a predetermined time, at a timing continuous to controlling the time display, that is, during the same period in which the processor circuit is operating. The processor 36 can therefore reduce power consumption by the processor circuit because the operating time of the processor circuit is shortened, and the number of times the process of evaluating the interrupt request signal executes can be reduced.

Increasing the size of the electronic timepiece 1 can also be suppressed because the processor 36 control multiple operations by the same processor circuit. Note that when the processor circuit that controls charge detection is different from the processor circuit that controls the time display, power consumption can still be reduced by executing the above process of the processor 36 because the processor circuit that controls charge detection must normally be energized only as many times as the charge is detected.

Figure 14:
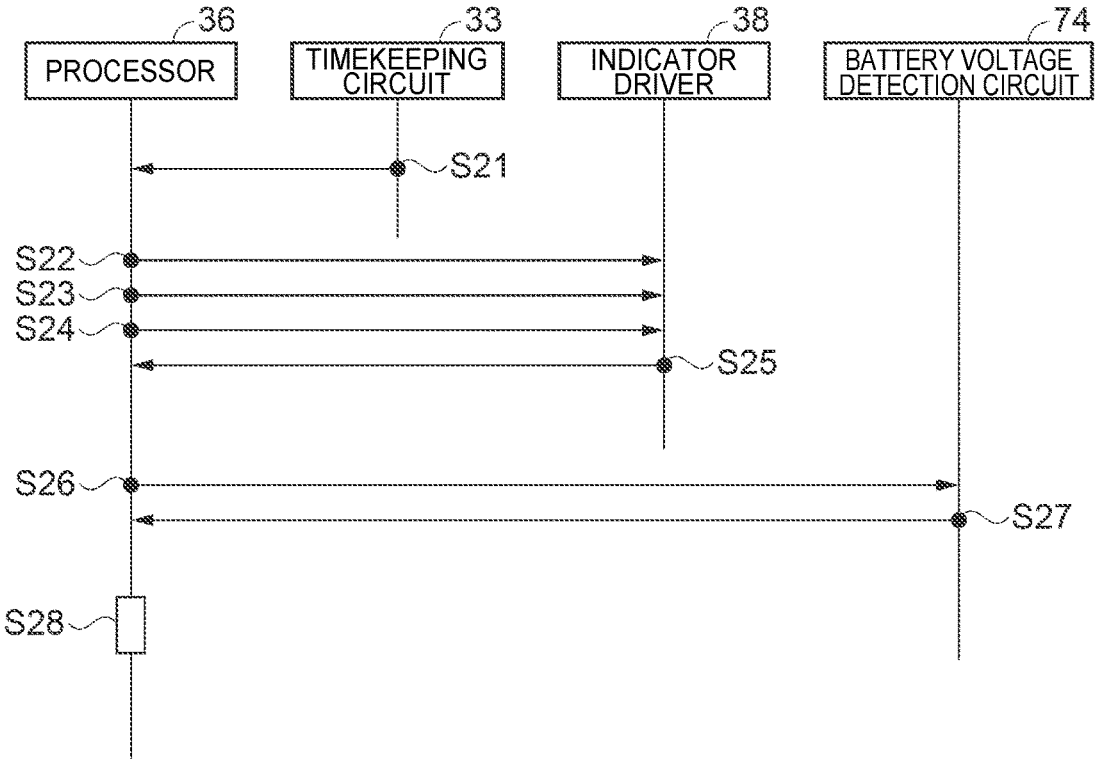
FIG. 14 is a sequence diagram describing another example of a process of the processor.

An example of the operation of the processor 36 when regularly detecting the battery voltage at a predetermined time is described next with reference to the sequence chart in FIG. 14. As in the example shown in FIG. 13, this example assumes that the timekeeping circuit 33 outputs an interrupt request signal to the processor 36 every five seconds based on the internal time. The example in FIG. 14 further supposes that the indicator driver 38 controls the three actuators that drive the hour hand 11*a*, minute hand 11*b*, and a date indicator not shown.

First, in step S21, the timekeeping circuit 33 outputs an interrupt request signal indicating the internal time to the processor 36.

In step S22, the processor 36 activates the processor circuit in response to the interrupt request signal, and outputs a control signal to the indicator driver 38 to drive the minute hand 11*b*.

In step S23, the processor 36 drives the hour hand 11*a* through the indicator driver 38 and the actuator at the 0 second of every minute.

In step S24, the processor 36 drives the date indicator through the indicator driver 38 and the actuator at 00:00:00.

In step S25, the indicator driver 38 outputs to the processor 36 a signal indicating that driving at least one of the hour hand 11*a*, minute hand 11*b*, and date indicator was completed.

In step S26, the processor 36 outputs a control signal requesting battery voltage detection to the battery voltage detection circuit 74 if the receiver 71 is not receiving signals and the internal time is the 30 second of the minute. In response to the control signal, the battery voltage detection circuit 74 detects the voltage of the storage battery 72.

In step S27, the battery voltage detection circuit 74 outputs a signal indicating the battery voltage to the processor 36. The processor 36 then stores the battery voltage in the storage 39.

In step S28, the processor 36 determines, based on the battery voltage stored in the storage 39, whether or not to change the power supply mode from the normal mode to the power save mode. If the processor 36 determines to change the power mode, it goes to the power save mode, and if it determines to not change the power mode, continues in the normal mode and then stops the processor circuit that was activated in step S22.

The processor 36 determines in step S26 whether or not the receiver 71 is receiving a signal. If the receiver 71 is receiving a signal, the processor 36 blocks battery voltage detection, and does not output a control signal requesting battery voltage detection to the battery voltage detection circuit 74. As a result, the processor 36 blocks execution of a function of a regularly scheduled operation when a specific condition is met, such as receiving radio signals in the time synchronization process. Because this can reduce the processing load of the processor circuit, the processor 36 can reduce the risk of operating errors in addition reducing power consumption. Other specific conditions for blocking execution of a function may include, for example, the processor circuit communicating with the receiver 71, storage 39 or other circuit according a standard such as SPI (Serial Peripheral Interface) or UART (Universal Asynchronous Receiver Transmitter). Other examples of specific conditions include executing processes that increase power consumption, such as driving an indicator quickly or wireless communication.

In addition, the processor 36 may drive the second hand 11*c* or other indicator 11 every integer number of seconds greater than one second. In this case, the processor 36 can reduce the number of times the processor circuit operates, and can reduce the operating time. The processor 36 may also execute processes each time the time display is controlled. In this case, the processor 36 can reduce the processing load of the processor circuit because there is no need to determine whether or not to execute a function that operates regularly.

The function that operates regularly is also not limited to charge detected or battery voltage detection. For example, when the electronic timepiece 1 has a sensor such as a barometric pressure sensor or directional sensor, the function may be detecting the value indicated by the sensor.

Other examples of functions that operate regularly include functions that acquire one or more of the current location, altitude, time zone, or current time using the receiver 71. Other examples of such functions include theoretical regulation to adjust the ratio of divisions in the frequency divider 32, and indicator position detection by the control circuit 35.

Embodiment 2

An electronic timepiece 1 according to a second embodiment differs from the first embodiment in that the indicator 11 is driven in the opposite direction in the second mode. Further description of configurations, operations, and effects that are the same as in the first embodiment are omitted in the second embodiment below.

Control Circuit Operation

Figure 15:
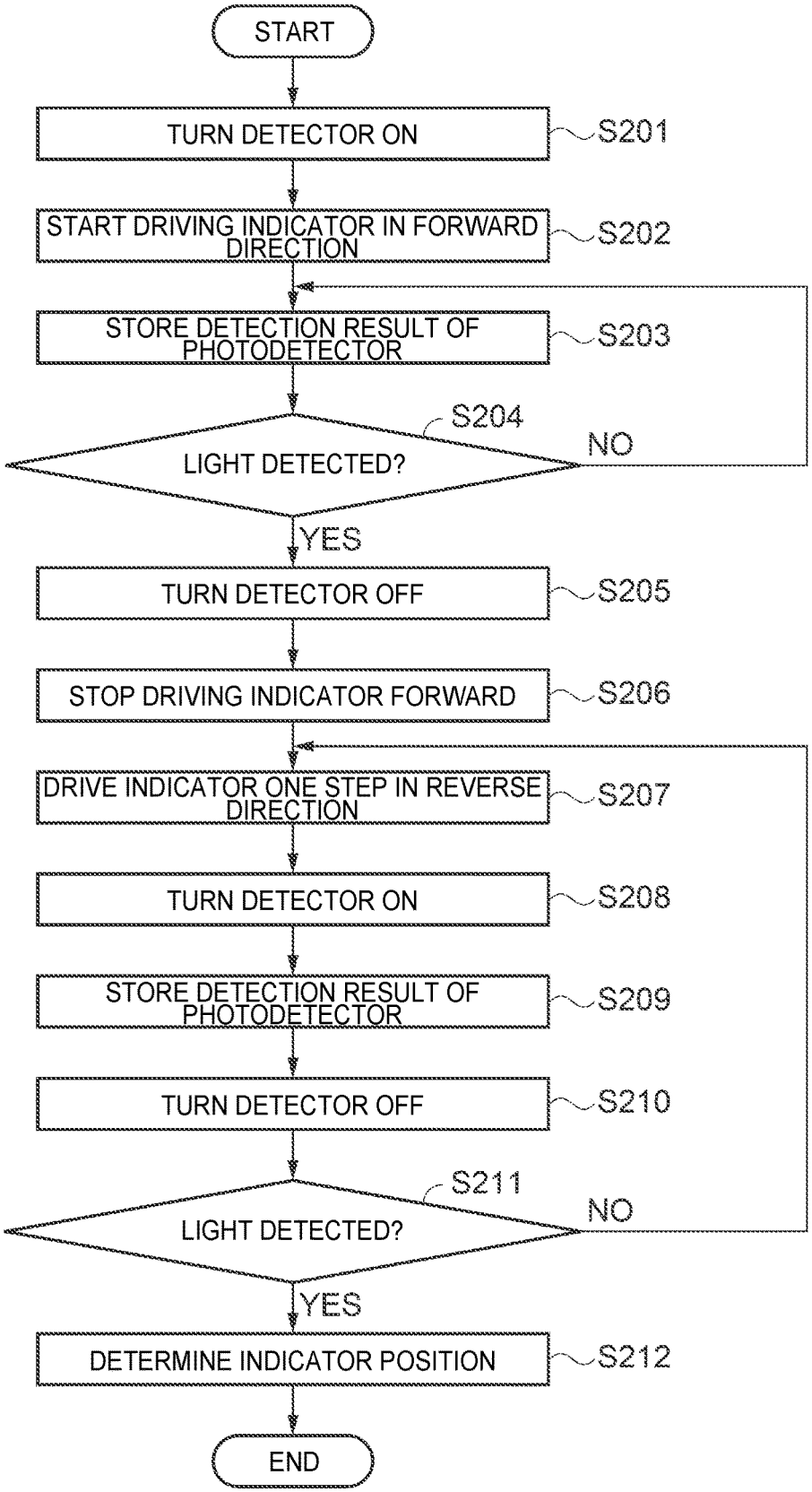
FIG. 15 is a flow chart describing an example of an indicator position detection method of an electronic timepiece according to a second embodiment.

The operation of the control circuit 35 is described below with reference to the flow chart in FIG. 15 as an example of the indicator position detection method of the electronic timepiece 1 according to the second embodiment. As in the first embodiment above, the process described in the example below uses the minute hand 11*b* shown in FIG. 3 as the indicator 11, the hour-minute motor 12*a* as the actuator 12, and the first detector 20*a* as the indicator position detector 20.

First, in step S201, the processor 36 starts the process in the first mode, and turns the first detector 20*a* on through the detector driver 37. More specifically, the detector driver 37 turns the first light source 21*a* on to start emitting by supplying power to the first light source 21*a*.

In step S202, the processor 36, through the indicator driver 38, starts driving the minute hand 11*b* in the forward direction, that is, clockwise. The indicator driver 38 drives the minute hand 11*b* continuously in one direction by outputting a drive signal to the hour-minute motor 12*a* and driving the hour-minute rotor 121*a*.

In step S203, the processor 36 stores the detection signal input from the first light sensor 22*a* through the detector driver 37 in the storage 39. Note that step S203 is executed multiple times at a specific sampling frequency, but the storage 39 does not need to store a history of all detection results, and may cyclically store the detection results at the sampling frequency.

In step S204, the processor 36 references the detection results most recently stored in the storage 39 in step S203, and determines whether or not the first light sensor 22*a* detected the light emitted from the first light source 21*a*. If the processor 36 determines light was detected, control goes to step S205; if the processor 36 determines light was not detected, control returns to step S203.

In step S205, the processor 36 turns the first detector 20*a* off through the detector driver 37. More specifically, the detector driver 37 stops light emission by the first light source 21*a* by stopping supplying power to the first light source 21*a*.

In step S206, the processor 36, through the indicator driver 38, stops driving the minute hand 11*b* in the forward direction, which started in step S202. More specifically, the indicator driver 38 stops driving the minute hand 11*b* by stopping output of the drive signal to the hour-minute motor 12*a* and stopping driving the hour-minute rotor 121*a*. As a result, the processor 36 ends the process in the first mode and goes to the second mode.

In step S207, the processor 36 starts the process of the second mode, and through the indicator driver 38 drives the minute hand 11*b* one step in the opposite direction, that is, counterclockwise. The indicator driver 38 drives the minute hand 11*b* in the opposite direction by outputting a drive signal to the hour-minute motor 12*a* and driving the hour-minute rotor 121*a* one step.

In step S208, the processor 36 turns the first detector 20*a* on through the detector driver 37. More specifically, the detector driver 37 causes the first light source 21*a* to start emitting by supplying power to the first light source 21*a*.

In step S209, the processor 36 stores the detection signal input from the first light sensor 22*a* through the detector driver 37 as the detection result in the storage 39. Note that step S209 is executed multiple times at a specific sampling frequency, but the storage 39 does not need to store a history of all detection results, and may cyclically store the detection results at the sampling frequency.

In step S210, the processor 36 turns the first detector 20*a* off through the detector driver 37. More specifically, the detector driver 37 stops light emission by the first light source 21*a* by stopping supplying power to the first light source 21*a*.

In step S211, the processor 36 references the detection result most recently stored in the storage 39 in step S209, and determines whether or not the first light sensor 22*a* detected the light emitted from the first light source 21*a*. If the processor 36 determines light was detected, control goes to step S212; but if the processor 36 determines light was not detected, control returns to step S207.

Because the first detector 20*a* detected the minute hand 11*b* at the reference position, the processor 36 ends the process in step S212 because the indicator 11 was confirmed to be at the reference position.

Note that as in the first embodiment the minute hand 11*b* moves in conjunction with the hour hand 11*a*, and the reference positions of the hour hand 11*a* and minute hand 11*b* are defined as the position when indicating 00:00 or 12:00. Therefore, the control circuit 35 can also be thought of as controlling the hour-minute motor 12*a* and first detector 20*a*, and detecting the reference positions of two hands, the hour hand 11*a* as an example of a first indicator, and the minute hand 11*b* as an example of a second indicator.

As described above, the control circuit 35 goes to the second mode in step S207 when the first light sensor 22*a* detects light in step S204 in the first mode. The control circuit 35 alternately drives the minute hand 11*b* and causes the first light source 21*a* to emit in steps S207 and S208 in the second mode. As a result, the control circuit 35 can shorten the time from the start to the end of detecting the indicator 11 at the reference position.

Other Embodiments

First and second embodiments are described above, but the invention is not limited thereto. The configuration of various parts may be replaced by other configurations having the same function, and desired configurations may be omitted or added within the scope of the accompanying claims. Other variations will therefore be apparent to one skilled in the related art from the embodiments described herein.

For example, the first and second embodiments describe executing indicator position detection as an initialization operation when the system resets triggered, for example, by the system starting up, but execution may also be triggered by a user operation. For example, the control circuit 35 may start the indicator position detection method in response to to a user operation of an operating member such as the button 402 shown in FIG. 2.

The first and second embodiments also describe a transmissive detector that detects by means of the photodetector 22 light emitted from a light emitter 21 and passing through a window provided in a wheel train that drives an indicator 11, but the indicator position detector 20 may be a reflective detector. More specifically, the photodetector 22 may be configured to detect light emitted from the light emitter 21 and reflected by a reflective surface on part of the wheel train or the indicator 11.

The invention may also obviously include configurations not described above, including configurations sharing configurations described above. The technical scope of the invention is defined only by elements of the invention described in the scope of the claims of the invention reasonably derived from the foregoing description.

The content of the foregoing embodiments may be summarized as described below.

An electronic timepiece according to the present disclosure includes an indicator; an actuator configured to drive the indicator; a light emitter used to detect the indicator; a photodetector configured to detect light emitted from the light emitter selectively when the indicator is at a reference position; and a control circuit configured to control the actuator and the light emitter, and execute a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

In this configuration the control circuit alternately drives the indicator and drives the light emitter to emit in the second mode after the indicator has past the reference position by driving the indicator continuously while the light emitter is emitting in the first mode. As a result, the time required from starting to completing detection of the indicator position can be shortened without degrading detection precision.

An electronic timepiece according to another aspect of the present disclosure has an indicator; an actuator configured to drive the indicator; a wheel configured to transfer power from the actuator to the indicator, and having a through-hole passing through the wheel in the axial direction; a light emitter configured to emit light to the wheel; a photodetector configured to detect light emitted from the light emitter and passing through the through-hole selectively when the indicator is at the reference position; and a control circuit configured to control the actuator and the light emitter, and execute a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

In this configuration the control circuit alternately drives the indicator and drives the light emitter to emit in the second mode after the indicator has past the reference position by driving the indicator continuously while the light emitter is emitting in the first mode. As a result, the time required from starting to completing detection of the indicator position can be shortened without degrading detection precision.

In the electronic timepiece thus comprised, the control circuit preferably drives the indicator in the opposite direction as the one direction when the photodetector detects light in the first mode, goes to the second mode when the indicator has been driven a specific amount in the opposite direction, and in the second mode alternately drives the indicator in the one direction and drives the light emitter to emit.

In this configuration the control circuit drives the indicator a specific amount in the opposite direction when the photodetector detects light in the first mode. As a result, an indicator that has moved past the reference position due to the time delay between output of the detection signal by the photodetector and when stopping the indicator ends can be returned to before the reference position.

In the electronic timepiece thus comprised, the control circuit, in the second mode, alternately drives the indicator in the opposite direction as the one direction, and drives the light emitter to emit.

In this configuration the control circuit alternately drives the indicator in the opposite direction and drives the light emitter to emit when the photodetector detects light in the first mode. As a result, detection can continue without returning an indicator that has moved past the reference position due to the time delay between output of the detection signal by the photodetector and when stopping the indicator ends to before the reference position. The time required from the start to completion of indicator position detection can be further reduced.

Preferably in the electronic timepiece described above the control circuit executes the processes of the first mode and second mode as an initialization operation during a system reset.

In this configuration an electronic timepiece in the initial state in which the position of the indicator is not known can determine the position of the indicator in a short time. As a result, when the system starts operating, the indicator can indicate information such as the time in a short time.

In the electronic timepiece described above the actuator is preferably a stepper motor.

By using a stepper motor to drive the indicator, this configuration can improve the precision and speed at which the indicator is driven.

In the electronic timepiece described above, the control circuit, in the second mode, alternately drives the stepper motor one step, and drives the light emitter to emit.

This configuration can detect the position of the indicator with great precision because the indicator is driven in increments of one step angle of the stepper motor.

In the electronic timepiece described above, the control circuit, in the first mode, drives the stepper motor by rated current control.

Because the indicator is driven by stepper motor controlled by rated current control, this configuration can further shorten the detection time in the first mode. Furthermore, by shortening the detection time, power consumption by the light emitter can be reduced.

An electronic timepiece control circuit according to another aspect of the present disclosure controls a light emitter and an actuator that drives an indicator; detects the indicator in a reference position by a photodetector that detects light emitted from the light emitter selectively when the indicator is at the reference position; and executes a first mode, while the light emitter is emitting, to drive the indicator continuously in one direction until the indicator is detected, and a second mode, after the photodetector detects light in the first mode and the indicator has past the reference position, to alternately drive the indicator and drive the light emitter to emit to detect the indicator at the reference position.

In this configuration the control circuit alternately drives the indicator and drives the light emitter to emit in the second mode after the indicator has past the reference position by driving the indicator continuously while the light emitter is emitting in the first mode. As a result, the time required from starting to completing detection of the indicator position can be shortened without degrading detection precision.

An indicator position detection method according to another aspect of the present disclosure includes: controlling, by a control circuit, a light emitter and an actuator that drives an indicator; detecting the indicator in a reference position by a photodetector that detects light emitted from the light emitter selectively when the indicator is at the reference position; driving the indicator continuously in one direction until the indicator is detected while the light emitter is emitting; and after the photodetector detects light and the indicator has past the reference position, alternately driving the indicator and driving the light emitter to emit to detect the indicator at the reference position.

In this configuration the control circuit alternately drives the indicator and drives the light emitter to emit in the second mode after the indicator has past the reference position by driving the indicator continuously while the light emitter is emitting in the first mode. As a result, the time required from starting to completing detection of the indicator position can be shortened without degrading detection precision.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2018-194858, filed Oct. 16, 2018 is expressly incorporated by reference herein.

What is claimed is:

1. An electronic timepiece comprising:

an indicator configured to rotate in a first direction and a second direction, which is opposite to the first direction, around an indicator axis;

a stepper motor configured to drive the indicator by one step at a time;

a light emitter configured to emit light;

a photodetector configured to selectively detect the light emitted from the light emitter when the indicator is at a reference position, the reference position corresponding to a specific one step position of the stepper motor; and a control circuit configured to control the stepper motor and the light emitter so as to:

perform a first mode, while the light emitter is continuously emitting the light, to drive the indicator continuously in the first direction for consecutive steps of the stepper motor until the photodetector detects the light;

turn the light emitter off after the photodetector detects the light;

cause the stepper motor to turn off to stop the driving of the indicator at a stop position after the light emitter is turned off, wherein the indicator has passed the reference position when the indicator stops;

cause the stepper motor to drive the indicator for a specific number of steps in the second direction from the stop position, wherein the indicator passes the reference position again during the driving for the specific number of steps in the second direction; and perform a second mode, after the indicator has passed the reference position again during the driving for the specific number of steps in the second direction, to perform an alternate operation between driving of the indicator by one step at a time in the first direction by the stepper motor and emitting of the light from the light emitter to determine whether the photodetector receives the light again so as to detect the indicator at the reference position.

2. The electronic timepiece according to claim 1, wherein the control circuit is configured to perform the first mode and the second mode as an initialization operation during a system reset.

3. The electronic timepiece according to claim 1, wherein the control circuit is configured to perform the first mode by driving the stepper motor by constant current control.

4. An electronic timepiece comprising:

an indicator configured to rotate in a first direction and a second direction, which is opposite to the first direction, around an indicator axis;

a stepper motor configured to drive the indicator by one step at a time;

a wheel configured to transfer power from the stepper motor to the indicator, the wheel having a through-hole passing through the wheel in an axial direction;

a light emitter configured to emit light toward the wheel;

a photodetector configured to selectively detect the light emitted from the light emitter and passing through the through-hole when the indicator is at a reference position, the reference position corresponding to a specific one step position of the stepper motor; and a control circuit configured to control the stepper motor and the light emitter so as to:

perform a first mode, while the light emitter is continuously emitting the light, to drive the indicator continuously in the first direction for consecutive steps of the stepper motor until the photodetector detects the light;

turn the light emitter off after the photodetector detects the light;

cause the stepper motor to turn off to stop the driving of the indicator at a stop position after the light emitter is turned off, wherein the indicator has passed the reference position when the indicator stops;

cause the stepper motor to drive the indicator for a specific number of steps in the second direction from the stop position, wherein the indicator passes the reference position again during the driving for the specific number of steps in the second direction; and perform a second mode, after the indicator has passed the reference position again during the driving for the specific number of steps in the second direction, to perform an alternate operation between driving of the indicator by one step at a time in the first direction by the stepper motor and emitting of the light from the light emitter to determine whether the photodetector receives the light again so as to detect the indicator at the reference position.

5. The electronic timepiece according to claim 4, wherein the control circuit is configured to perform the first mode and the second mode as an initialization operation during a system reset.

6. The electronic timepiece according to claim 4, wherein the control circuit is configured to perform the first mode by driving the stepper motor by constant current control.

7. An indicator position detection method for causing a control circuit to execute a process, the indicator position detection method comprising executing on the control circuit the steps of:

rotating an indicator in a first direction and a second direction, which is opposite to the first direction, around an indicator axis via a stepper motor, the stepper motor being configured to drive the indicator by one step at a time;

controlling a light emitter, the light emitter being configured to emit light;

causing a photodetector to selectively detect the light emitted from the light emitter when the indicator is at a reference position, the reference position corresponding to a specific one step position of the stepper motor;

performing a first mode, while the light emitter is continuously emitting the light, to drive the indicator continuously in the first direction for consecutive steps of the stepper motor until the photodetector detects the light;

turning the light emitter off after the photodetector detects the light;

causing the stepper motor to turn off to stop the driving of the indicator at a stop position after the light emitter is turned off, wherein the indicator has passed the reference position when the Indicator stops;

causing the stepper motor to drive the indicator for a specific number of steps in the second direction from the stop position, wherein the indicator passes the reference position again during the driving for the specific number of steps in the second direction; and performing a second mode, after the indicator has passed the reference position again during the driving for the specific number of steps in the second direction, to perform an alternate operation between driving of the indicator by one step at a time in the first direction by the stepper motor and emitting of the light from the light emitter to determine whether the photodetector receives the light again so as to detect the indicator at the reference position.

8. The indicator position detection method according to claim 7, wherein the control circuit is configured to perform the first mode and the second mode as an initialization operation during a system reset.

9. The indicator position detection method according to claim 7, wherein the control circuit is configured to perform the first mode by driving the stepper motor by constant current control.

* * * * *